US011781387B2

(12) United States Patent
Patterson et al.

(10) Patent No.: US 11,781,387 B2
(45) Date of Patent: Oct. 10, 2023

(54) COLLAPSIBLE MUD BUCKET

(71) Applicant: Nabors Drilling Technologies USA, Inc., Houston, TX (US)

(72) Inventors: Derek Patterson, Houston, TX (US); David Siljeg, The Woodlands, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 17/538,675

(22) Filed: Nov. 30, 2021

(65) Prior Publication Data

US 2022/0178216 A1 Jun. 9, 2022

Related U.S. Application Data

(60) Provisional application No. 63/123,186, filed on Dec. 9, 2020.

(51) Int. Cl.
*E21B 21/01* (2006.01)
*E21B 19/16* (2006.01)

(52) U.S. Cl.
CPC ..... *E21B 21/01* (2013.01); *E21B 19/16* (2013.01)

(58) Field of Classification Search
CPC ..... E21B 21/01; E21B 19/16; E21B 43/0122
See application file for complete search history.

(56) References Cited

U.S. PATENT DOCUMENTS 3,530,566 A * 9/1970 Abercrombie ..... F16J 3/048 29/454
3,561,220 A * 2/1971 Riester ..... E21B 43/0122 405/60
4,450,905 A 5/1984 Crain
5,295,536 A 3/1994 Bode
6,102,673 A 8/2000 Mott et al.
7,114,235 B2 10/2006 Jansch et al.
7,306,032 B2 12/2007 Paton
8,281,867 B2 10/2012 Belik
8,733,435 B2 5/2014 Webb
8,763,684 B2 7/2014 Pearson
8,839,853 B1 9/2014 Angers, Jr.
8,955,602 B2 2/2015 Pilgrim
(Continued)

FOREIGN PATENT DOCUMENTS

WO 2020/178568 A2 9/2020
WO 2020/222860 A1 11/2020

*Primary Examiner* — Aaron L Lembo
(74) *Attorney, Agent, or Firm* — Abel Schillinger, LLP

(57) ABSTRACT

A mud bucket system including a base structure and a bellows with a longitudinal internal cavity, the base structure attached to one end of the bellows and a retention ring attached to another end, where the vertical movement of the retention ring lengthens or shortens the longitudinal internal cavity, and a method of using the system that can include coupling a mud bucket to a rig floor, raising a retention ring of the mud bucket, thereby elongating a longitudinal internal cavity of the mud bucket such that a connection of a tubular string is positioned within the longitudinal internal cavity, and unthreading the connection while the connection is positioned within the longitudinal internal cavity, where a tubular is connected to the tubular string at the connection and unthreading the connection disconnects the tubular from the tubular string and expels a fluid from the tubular into the longitudinal internal cavity.

20 Claims, 20 Drawing Sheets

(56) References Cited

U.S. PATENT DOCUMENTS

| | | | | |
|---|---|---|---|---|
| 9,453,392 | B1 * | 9/2016 | Marchiori | E21B 21/01 |
| 9,664,002 | B2 | 5/2017 | Webb | |
| 9,982,497 | B2 | 5/2018 | Foley | |
| 10,927,619 | B1 | 2/2021 | Anthony | |
| 11,168,533 | B1 * | 11/2021 | Pruitt | E21B 33/08 |
| 2002/0070029 | A1 | 6/2002 | Miramon | |
| 2003/0146219 | A1 | 8/2003 | Ross | |
| 2018/0230762 | A1 | 8/2018 | Blaine et al. | |
| 2019/0136669 | A1 | 5/2019 | Wiedecke et al. | |
| 2021/0301606 | A1 | 9/2021 | Mikalsen | |
| 2021/0301628 | A1 * | 9/2021 | Hope | E21B 19/16 |
| 2022/0325597 | A1 * | 10/2022 | Karuppoor | E21B 33/10 |

* cited by examiner

Section 6C-6C

Section 6B-6B

Section 7B-7B

Detail 8B

Detail 18D

Detail 18D

COLLAPSIBLE MUD BUCKET

CROSS-REFERENCE TO RELATED APPLICATION(S)

This application claims priority under 35 U.S.C. § 119(e) to U.S. Patent Application No. 63/123,186, entitled "COLLAPSIBLE MUD BUCKET," by Derek PATTERSON et al., filed Dec. 9, 2020, which application is assigned to the current assignee hereof and incorporated herein by reference in its entirety.

TECHNICAL FIELD

The present invention relates, in general, to the field of drilling and processing of wells. More particularly, present embodiments relate to a system and method for collecting expelled fluid from a tubular being disconnected from a tubular string during subterranean operations.

BACKGROUND

When tripping a tubular string out of a wellbore, tubulars are sequentially disconnected from the top end of the tubular string. The tubulars being removed from the tubular string can contain drilling mud or other fluids which are expelled from the tubular when its connection to the tubular string is disconnected (e.g., unthreaded). Devices have been developed to capture this expelled fluid for each tubular disconnection and drain the fluid away from well center to a collection chamber (e.g., mud storage, mud pit, moon pool, etc.). These devices can be referred to as "mud buckets". These mud buckets are generally complicated clamshell fixtures that can clamp and seal around a tubular string connection that is to be disconnected, with the mud bucket capturing and draining away the expelled fluid from well center. The mud bucket can then unclamp and move away from the well center. This clamping/unclamping process can take up precious rig time, regardless of the speed of the process. Also, the large clamshell fixtures require valuable rig floor space for storage away from the well center. Therefore, improvements in capturing and removing expelled fluid from well center during tripping operations are continually needed.

SUMMARY

A system of one or more computers can be configured to perform particular operations or actions by virtue of having software, firmware, hardware, or a combination of them installed on the system that in operation causes or can cause the system to perform the actions. One or more computer programs can be configured to perform particular operations or actions by virtue of including instructions that, when executed by the data processing apparatus, cause the apparatus to perform the actions. One general aspect includes a system for performing a subterranean operation. The system can include a base structure configured to couple to a rig floor; a bellows with a longitudinal internal cavity, with one end of the bellows attached to the base structure; and a retention ring attached to an opposite end of the bellows, where the vertical movement of the retention ring lengthens or shortens the longitudinal internal cavity.

One general aspect includes a method for performing a subterranean operation. The method can include coupling a mud bucket to a rig floor; raising a retention ring of the mud bucket, thereby elongating a longitudinal internal cavity of the mud bucket such that a joint of a tubular string is positioned within the longitudinal internal cavity; and unthreading the joint while the joint is positioned within the longitudinal internal cavity, where a tubular is connected to the tubular string at the joint and unthreading the joint disconnects the tubular from the tubular string and expels a fluid from the tubular into the longitudinal internal cavity. Other embodiments of this aspect include corresponding computer systems, apparatus, and computer programs recorded on one or more computer storage devices, each configured to perform the actions of the methods.

One general aspect includes a method for performing a subterranean operation. The method can include raising a tubular string through a mud bucket at well center on a rig until a joint is positioned above the mud bucket; untorquing the joint via a torque wrench and backup tong, elongating a bellows of the mud bucket to elongate a longitudinal internal cavity of the mud bucket, unthreading the joint to disconnect a tubular from the tubular string, releasing fluid from the tubular into the longitudinal internal cavity, capturing the fluid in the longitudinal internal cavity, and flowing the fluid away from the well center via a drain port of the mud bucket. Other embodiments of this aspect include corresponding computer systems, apparatus, and computer programs recorded on one or more computer storage devices, each configured to perform the actions of the methods.

One general aspect includes a system for performing a subterranean operation. The system can include a base structure configured to couple to a lower side of a backup tong; a bellows having a longitudinal internal cavity, with one end of the bellows coupled to an upper side of the backup tong of an iron roughneck and an opposite end of the bellows coupled to a retention ring that is coupled to a lower side of a torque wrench of an iron roughneck, where the vertical movement of the retention ring lengthens or shortens the longitudinal internal cavity.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present), and B is false (or not present), A is false (or not present), and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
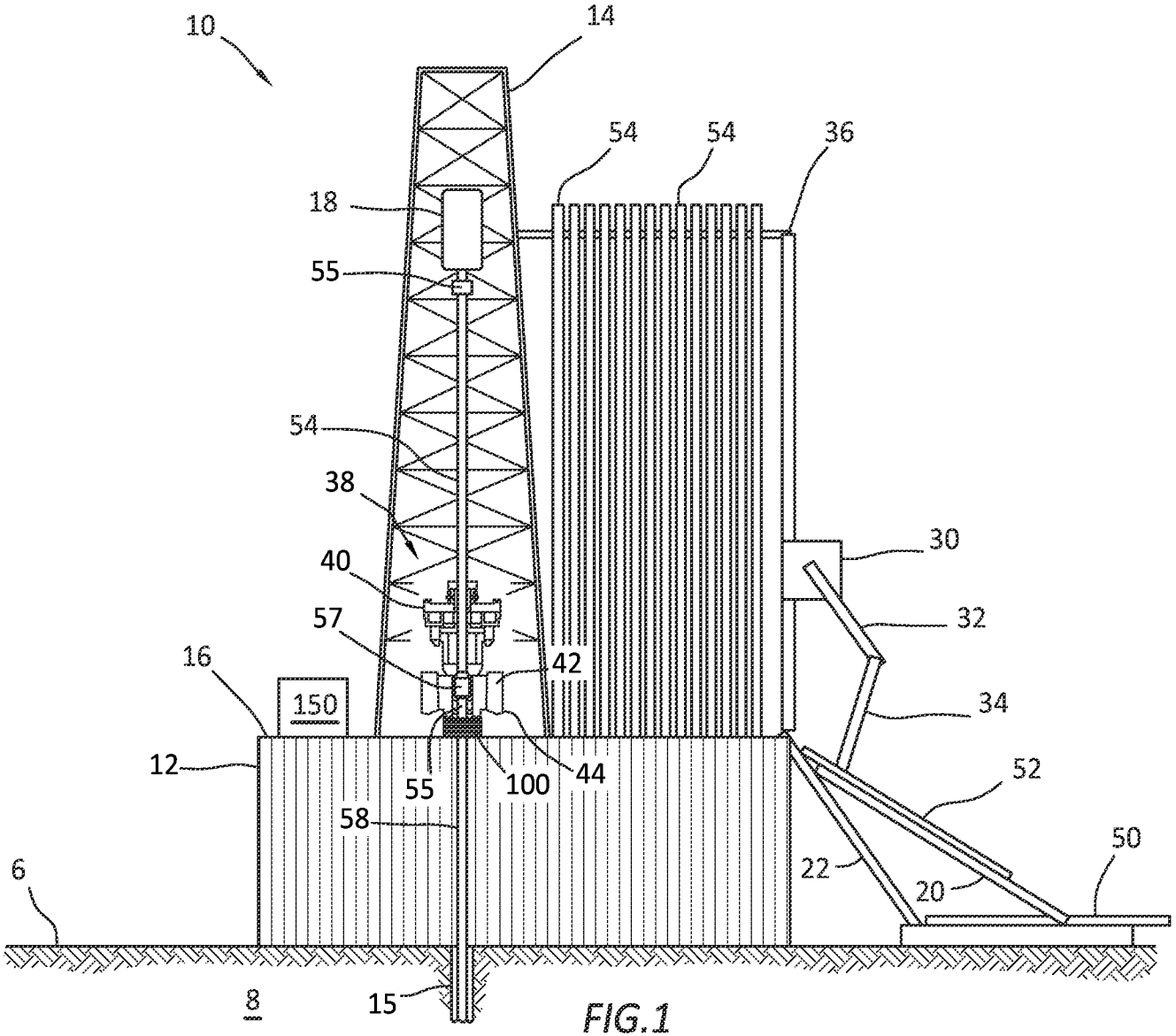
FIG. 1 is a representative simplified front view of a rig being utilized for a subterranean operation, in accordance with certain embodiments.

As used herein, "tubular" refers to an elongated cylindrical tube and can include any of the tubulars manipulated around a rig, such as tubular segments, tubular stands, tubulars, and tubular string, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

FIG. 1 is a representative simplified front view of a rig being utilized for a subterranean operation (e.g., tripping in or out a tubular string to or from a wellbore), in accordance with certain embodiments. The rig 10 can include a platform 12 with a rig floor 16 and a derrick 14 extending up from the rig floor 16. The derrick 14 can provide support for hoisting the top drive 18 as needed to manipulate tubulars. A catwalk 20 and V-door ramp 22 can be used to transfer horizontally stored tubular segments 50 to the rig floor 16. A tubular segment 52 can be one of the horizontally stored tubular segments 50 that is being transferred to the rig floor 16 via the catwalk 20. A pipe handler 30 with articulating arms 32, 34 can be used to grab the tubular segment 52 from the catwalk 20 and transfer the tubular segment 52 to the top drive 18, the fingerboard 36, the wellbore 15. etc. However, it is not required that a pipe handler 30 be used on the rig 10. The top drive 18 can transfer tubulars directly between the catwalk 20 and a well center on the rig floor (e.g., using an elevator coupled to the top drive).

The tubular string 58 can extend into the wellbore 15, with the wellbore 15 extending through the surface 6 into the subterranean formation 8. When tripping the tubular string 58 into the wellbore 15, tubulars 54 are sequentially added to the tubular string 58 to extend the length of the tubular string 58 into the earthen formation 8. FIG. 1 shows a land-based rig. However, it should be understood that the principles of this disclosure are equally applicable to off-shore rigs where "off-shore" refers to a rig with water between the rig floor and the earth surface 6. When tripping the tubular string 58 out of the wellbore 15, tubulars 54 are sequentially removed from the tubular string 58 to reduce the length of the tubular string 58 in the wellbore 15.

When tripping the tubular string 58 into the wellbore 15, the pipe handler 30 can be used to deliver the tubulars 54 to a well center on the rig floor 16 in a vertical orientation and hand the tubulars 54 off to an iron roughneck 38 or a top drive 18. When tripping the tubular string 58 out of the wellbore 15, the pipe handler 30 can be used to remove the tubulars 54 from the well center in a vertical orientation and receive the tubulars 54 from the iron roughneck 38 or a top drive 18. The iron roughneck 38 can make a threaded connection between a tubular 54 being added and the tubular string 58. A spinner assembly 40 can engage a body of the tubular 54 to spin a pin end 57 of the tubular 54 into a threaded box end 55 of the tubular string 58, thereby threading the tubular 54 into the tubular string 58. The spinner assembly 40 can also be built into the iron roughneck 38, as shown, built into a pipe handler, or be a separate component to the iron roughneck 38. The backup tong 44 and the torque wrench assembly 42 can provide a desired torque to the threaded connection, thereby completing the connection.

This process can be reversed when the tubulars 54 are being removed from the tubular string 58. When tripping the tubular string 58 out of the wellbore 15, the tubular 54 to be removed from the tubular string 58 can contain drilling mud or other fluids which are expelled from the tubular 54 when its connection to the tubular string 58 is unthreaded. Devices have been developed to capture this expelled fluid and drain it away from well center to a collection chamber (e.g., mud storage, mud pit, moon pool, etc.). These devices can be referred to as "mud buckets". These mud buckets are generally complicated clamshell fixtures that can clamp and seal around the connection to be unthreaded to capture the expelled fluid and then unclamp and move away from well center. This clamping/unclamping process can take up precious rig time, regardless of the speed of the process.

The current disclosure provides a mud bucket 100 that simplifies the collection of expelled fluids and can work with (but not limited to) automated rig operation to minimize rig time dedicated to the positioning of the mud bucket. The mud bucket 100 can be removably connected between the bottom side of the backup tong and the slips at well center. When the roughneck 38 breaks loose a tubular connection, the roughneck 38 can raise vertically to expand a bellows of the mud bucket 100. With the expanded bellows extended past the connection being unthreaded, the expelled fluid can be captured and drained away from well center. The mud bucket 100 does not need to move away from well center between each disconnection. It can remain collapsed at well center when the roughneck 38 moves away from well center to allow clearance for the top drive to be lowered to engage the stump at well center. When the roughneck 38 is moved to align with the next connection in the tubular string 58 to break it loose, the iron roughneck 38 can again engage the collapsed mud bucket 100 and expand it to capture fluid from the next broken connection of the tubular string 58. This can minimize rig time dedicated to capturing the expelled fluids.

A rig controller 150 can be used to control the rig 10 operations including controlling various rig equipment, such as the pipe handler 30, the top drive 18, and the iron roughneck 38. The rig controller 150 can control the rig equipment autonomously (e.g., without periodic operator interaction), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation). A portion of the rig controller 150 can also be distributed around the rig 10, such as having a portion of the rig controller 150 (e.g., local processors) in the pipe handler 30, in the iron roughneck 38, or around the rig 10.

Figure 2:
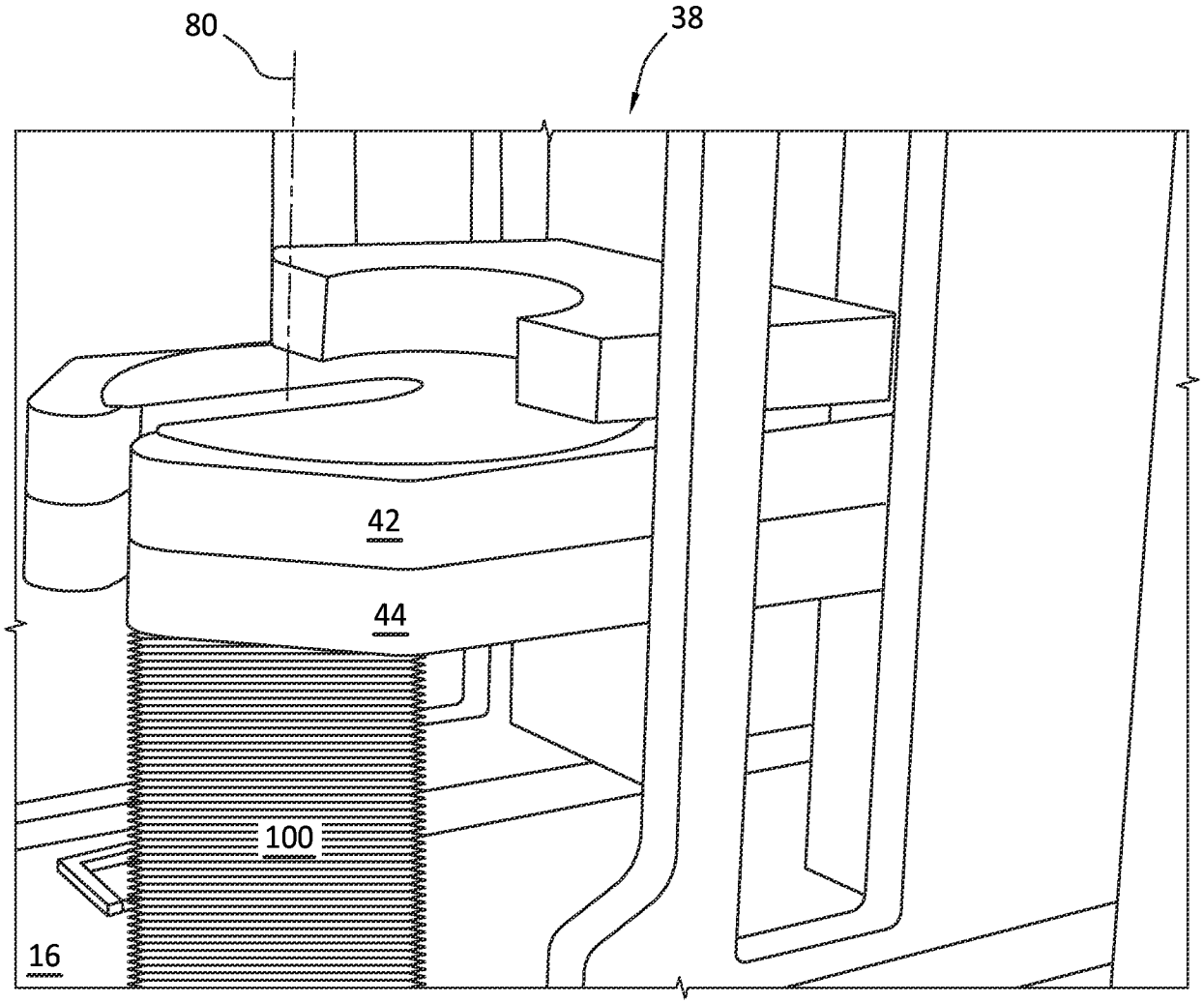
FIGS. 2 and 3 are representative perspective views of robotic iron roughnecks that can each be used to interface with the mud bucket to collect expelled fluids from a tubular being unthreaded from a tubular string, in accordance with certain embodiments.

FIG. 2 is a representative perspective view of a robotic iron roughneck 38 that can also be used to interface with the mud bucket 100 to collect expelled fluids from a tubular 54 being unthreaded from a tubular string 58. The mud bucket 100 can be removably attached to the bottom of the backup tong 44 at one end and removably attached to the slips (not shown) at the other opposite end. As the backup tong 44 is moved vertically, the bellows of the mud bucket 100 expand or collapse. The mud bucket 100 can have a center axis 80 that can be aligned with a longitudinal axis (not shown) of a tubular string 58 extending above a rig floor 16.

Figure 3:
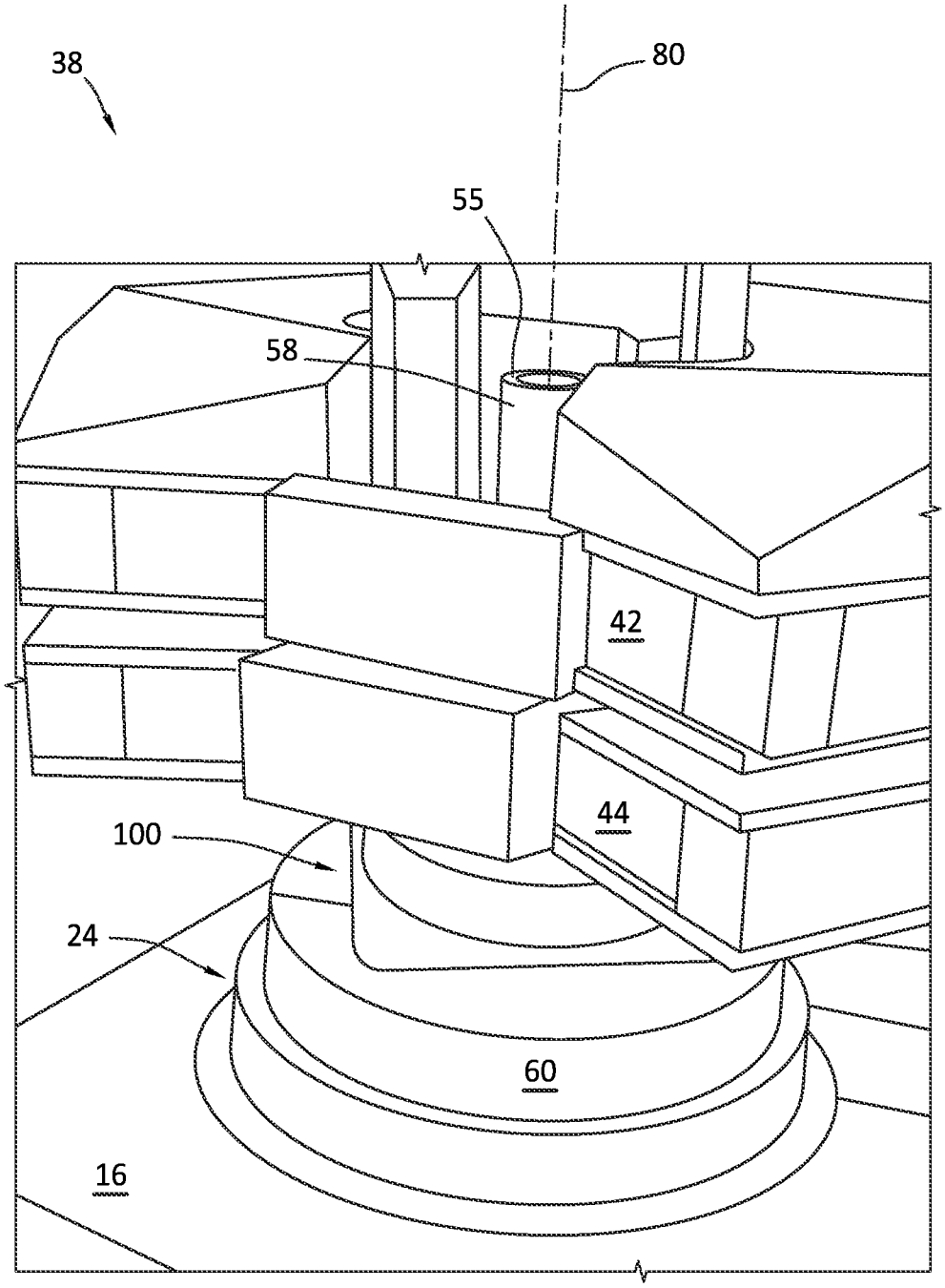

FIG. 3 is a perspective view of another robotic iron roughneck 38 that can be used to interface with the mud bucket 100 to collect expelled fluids from a tubular 54 being unthreaded from a tubular string 58. The mud bucket 100 can be removably attached to the bottom of the backup tong 44 at one end and removably attached to the slips 60 at the other opposite end. As the backup tong 44 is moved vertically, the bellows of the mud bucket 100 expand or collapse. The mud bucket 100 can have a center axis 80 that can be aligned with a longitudinal axis of a tubular string 58 extending above a rig floor 16. The box end 55 of the tubular string 58 is shown as a stump of the tubular string 58 without a tubular 54 connected to the box end 55. However, when the tubular string 58 is being tripped out of the wellbore 15, the pin end 57 of a tubular 54 can be connected to the box end 55 of the tubular string 58. To disconnect the tubular 54 (not shown in this figure, see FIG. 1), the roughneck 38 can position the torque wrench 42 and backup tong 44 at a connection in the tubular string 58 to untorque the connection.

Figure 4:
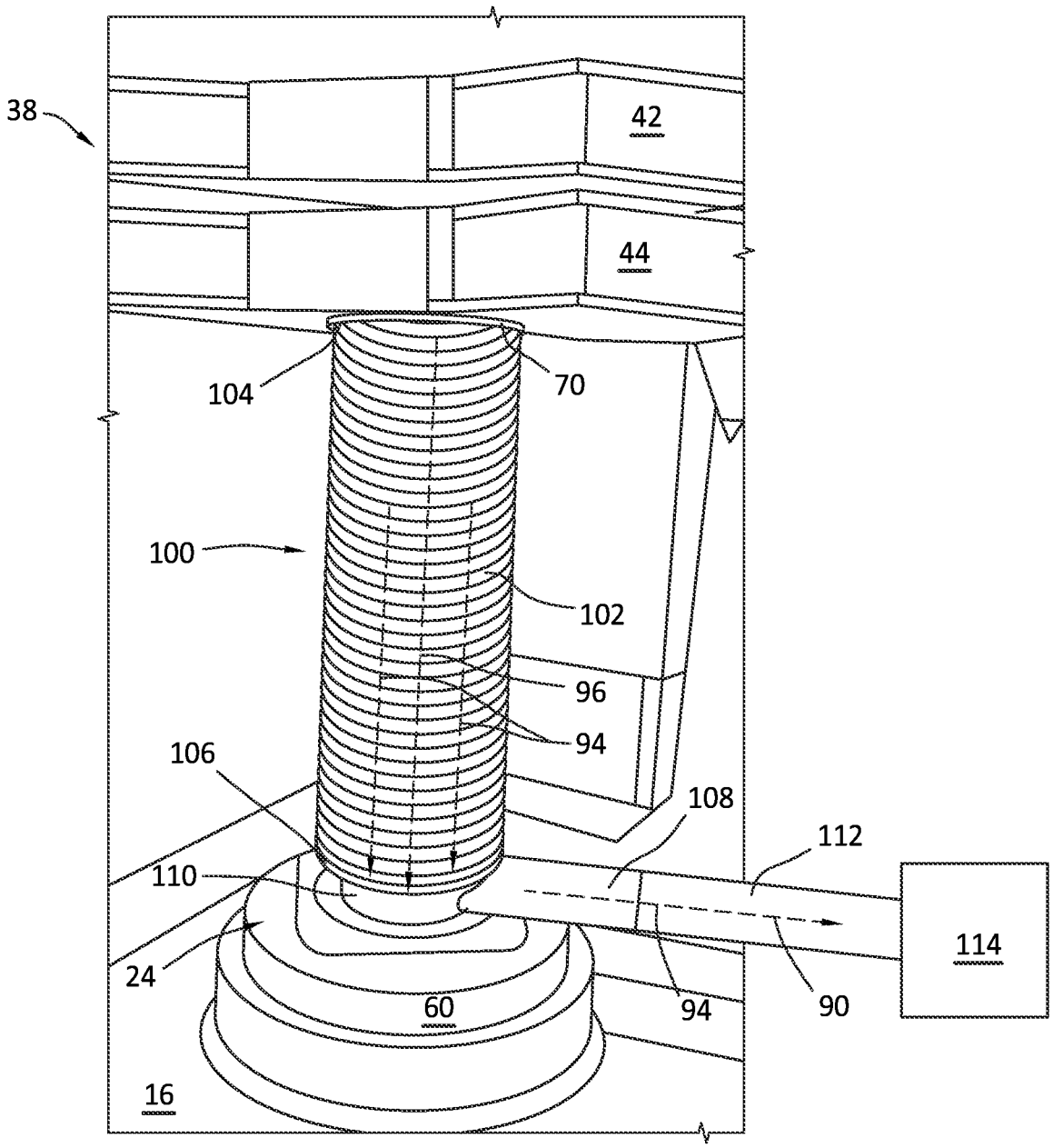
FIG. 4 is a representative perspective view of a robotic iron roughneck of FIG. 3 with the mud bucket expanded to collect expelled fluids from a tubular being unthreaded from a tubular string, in accordance with certain embodiments.

FIG. 4 is a representative perspective view of a robotic iron roughneck 38 of FIG. 3 with the mud bucket expanded to collect expelled fluids from a tubular being unthreaded from a tubular string 58. With a pipe handler (e.g., pipe handler 30, top drive, spinner, etc.) engaged with the tubular 54 being disconnected, the iron roughneck 38 can raise the backup tong 44 to expand the mud bucket 100 to above the connection being disconnected. Then the pipe hander can disconnect (e.g., unthread) and remove the tubular 54 from the tubular string 58, with the bellows 102 of the mud bucket 100 constraining the expelled fluid coming from the tubular 54 and directing the expelled fluid to the base structure 110 and out the drain port 108 (arrows 90) into a drain hose 112, and eventually to a collection chamber 114 (e.g., mud storage, mud pit, moon pool, etc.).

An upper end 104 of the bellows 102 can be removably connected to the backup tong 44 via an interface structure 70, which can be fixedly attached to the backup tong 44. When the backup tong 44 is raised, the interface structure 70 can retain the upper end 104 proximate the backup tong 44 and expand the bellows 102 past the connection in the tubular string 58 that is about to be disconnected. The lower end 106 of the bellows 102 can be attached to a base structure 110 that can receive the expelled fluid from the tubular 54 being disconnected and direct the fluid out the drain port 108, through the drain hose 112, and to the collection chamber 114. The base structure 110 can be attached to the lower end 106 of the bellows 102 to secure the bellows 102 to the base structure while the upper end 104 is moved vertically due to movement of the backup tong 44. The bellows 102 includes a longitudinal internal cavity 96 that extends through the bellows 102 from the upper end 104 to the lower end 106. Expelled fluid 94 can flow through at least a portion of the longitudinal internal cavity 96 and into the base structure 110, which can divert the expelled fluid 94 through the drain port 108 along the flow path 90. The extension of the bellows 102 lengthens the longitudinal internal cavity 96 and collapsing the bellows 102 shortens the longitudinal internal cavity 96. A seal (not shown) can be positioned at each end 104, 106 of the bellows 102. Seals 130 at the end 106 and seal 160 at the end 104 are described below. The fluid 94 can be expelled into the longitudinal internal cavity 96 and directed by gravity to the base structure 110 and out the drain port 108.

The base structure 110 can be coupled to the slips 60 (or other equipment at well center 24 on the rig floor 16) via bit breaker recesses in the slips 60 (or other equipment at well center 24). The coupling of the base structure 110 to the slips 60 will be described in more detail below.

Figure 5:
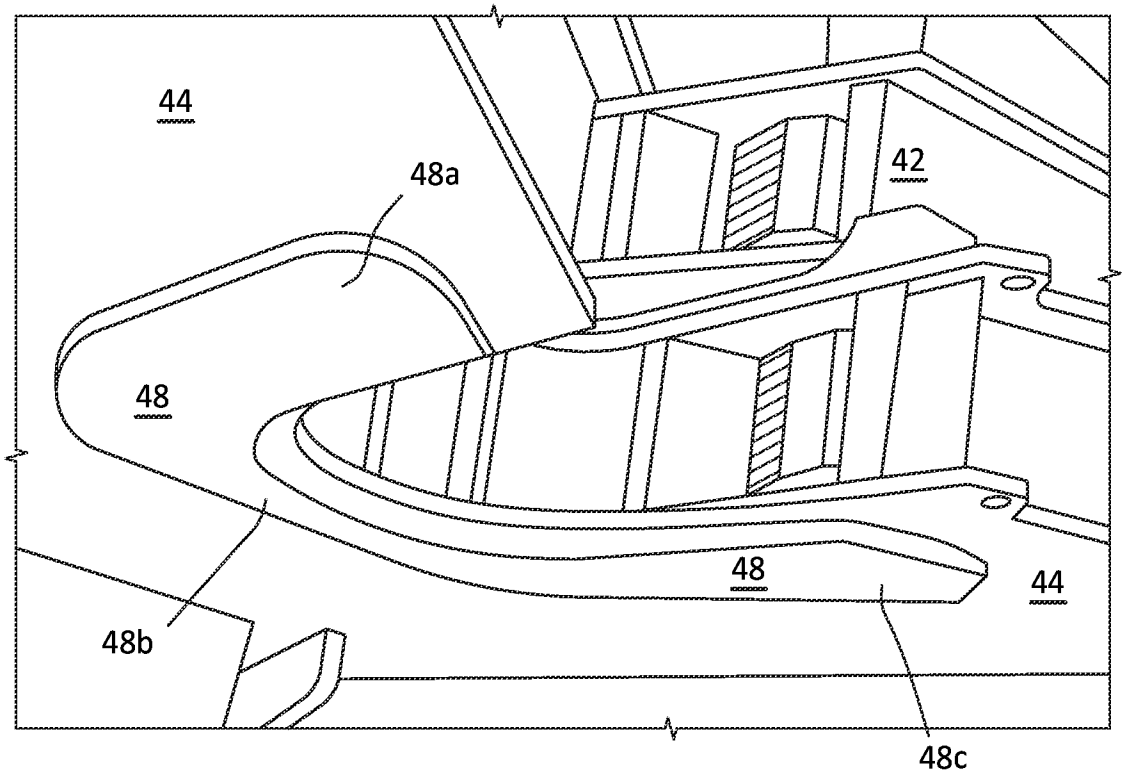
FIG. 5 is a representative perspective bottom view of a backup tong of a robotic iron roughneck, in accordance with certain embodiments.

FIG. 5 is a representative perspective bottom view of a backup tong 44 of a robotic iron roughneck 38. On the bottom of the backup tong 44 is a U-shaped raised attachment surface 48 that can be used to couple the interface structure 70 to the backup tong 44. The attachment surface 48 can include a left portion 48*a*, a back portion 48*b*, and a right portion 48*c*. These portions can be associated with the left, back and right portions of the interface structure 70 (see FIG. 7A).

Figure 6A:
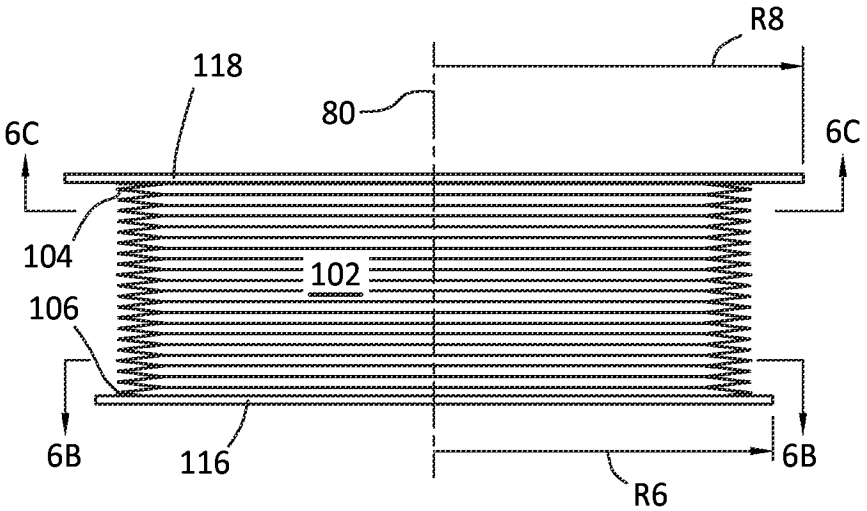
FIG. 6A is a representative side view of a bellows used in the mud bucket, in accordance with certain embodiments.

FIG. 6A is a representative side view of a bellows 102 used in the mud bucket 100. The bellows 102 can include a lower attachment ring 116 for attaching to the base structure 110 and an upper retention ring 118 for removable attachment to the interface structure 70 (or interface adapter 170 shown in FIGS. 16A-18E). The lower end 106 of the bellows 102 can be fixedly attached (e.g., glued, adhered, fastened, etc.) to one side of the attachment ring 116 with the other side of the attachment ring 116 removably attached to the base structure 110. The upper end 104 of the bellows 102 can be fixedly attached (e.g., glued, adhered, fastened, etc.) to one side of the retention ring 118.

Figure 6C:
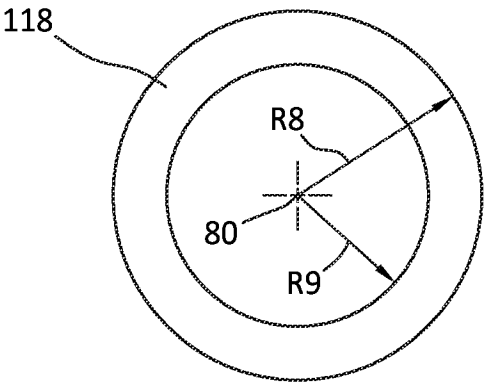
FIG. 6C is a representative bottom view of a retention ring attached to a top of the bellows of the mud bucket, in accordance with certain embodiments.
Figure 6B:
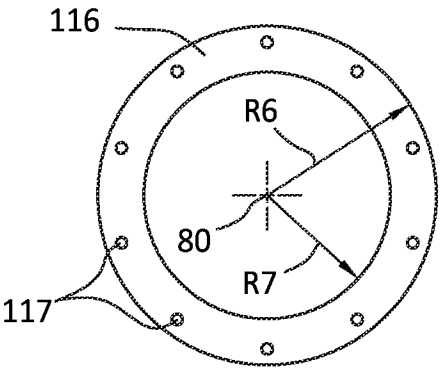
FIG. 6B is a representative top view of an attachment ring attached to a bottom of the bellows of the mud bucket, in accordance with certain embodiments.

FIG. 6B is a representative top view of an attachment ring 116 attached to a lower end 106 of the bellows 102 of the mud bucket 100. The attachment ring 116 can have an inner radius of R7 and an outer radius R6, with holes 117 circumferentially spaced around the ring. These holes can align with holes on the base structure 110 through which fasteners can be inserted to secure the lower end 106 of the bellows 102 to the base structure 110. The attachment ring 116 can have an appropriate thickness to maintain structural integrity during usage of the mud bucket 100.

FIG. 6C is a representative bottom view of a retention ring 118 attached to an upper end 104 of the bellows of the mud bucket 100. The retention ring 118 can have an inner radius of R9 and an outer radius R8, with an appropriate thickness to maintain structural integrity during usage of the mud bucket 100. The retention ring 118 does not need to include circumferentially spaced holes, since the retention ring 118 is not fastened to the backup tong via fasteners. However, it should be understood that the retention ring 118 could be fastened to the backup tong via fasteners. The retention ring 118 can be slid into a U-shaped channel 78 (see FIGS. 7A-7B) that is formed in the interface structure 70 when the interface structure 70 is attached to the attachment surface 48 of the backup tong 44. While the retention ring 118 is inserted into the U-shaped channel 78, the upper end 104 of the bellows 102 will move vertically with the backup tong 44.

Figure 7A:
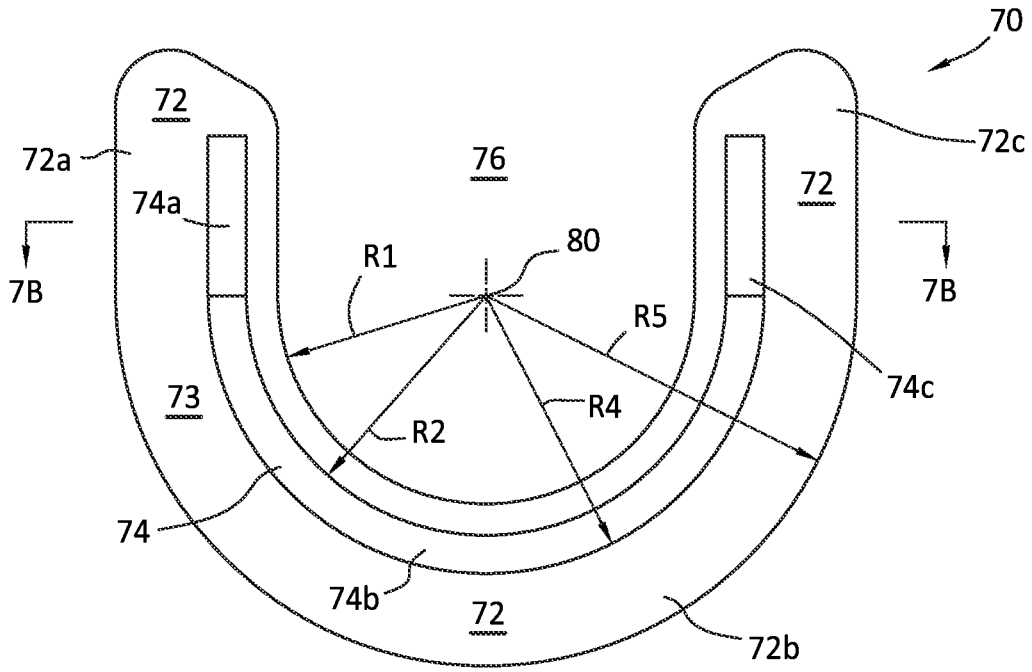
FIG. 7A is a representative bottom view of an interface structure that removably attaches a mud bucket to a backup tong of an iron roughneck, in accordance with certain embodiments.
Figure 7B:
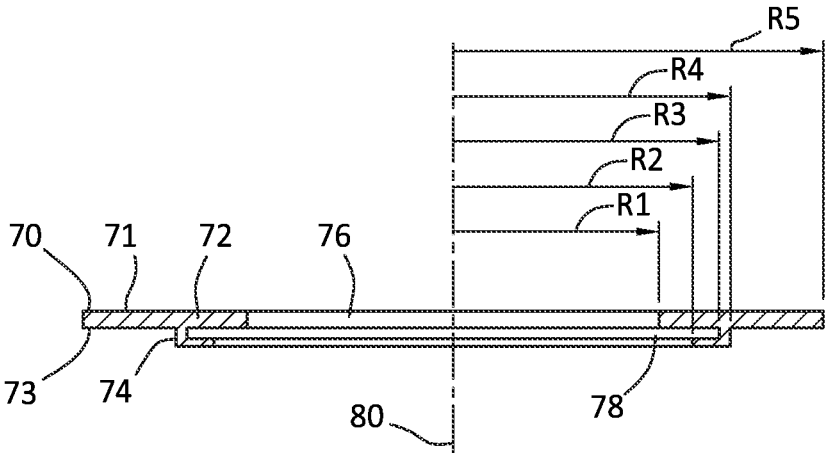
FIG. 7B is a representative partial cross-sectional view of the interface structure of FIG. 7A along line 7B-7B, in accordance with certain embodiments.

In a non-limiting embodiment, FIG. 7A is a representative bottom view of an interface structure 70 that can be removably or fixedly attached to a backup tong 44 of an iron roughneck 38. FIG. 7B is a representative partial cross-sectional view of the interface structure of FIG. 7A along line 7B-7B. It should be understood that the interface structure 70 can be mounted to any appropriate rig equipment other than a backup tong 44, as long as the equipment can raise and lower the interface structure 70 thereby elongating (i.e., expanding) or retracting (i.e., collapsing) the bellows 102 for capturing expelled fluids. Referring to FIGS. 7A, 7B, the interface structure 70 can include a U-shaped plate (also referred to as an attachment interface) 72 that can include a left portion 72*a*, a back portion 72*b*, and a right portion 72*c*. The left and right portions 72*a*, 72*c* are straight portions of the U-shape with the back portion 72*b* being a curved portion of the U-shape having an inner radius R1 and an outer radius R5. The U-shape provides for a lateral opening 76 between the left and right portions 72*a*, 72*c*.

The U-shaped plate 72 can include a top surface 71 that can be attached to the backup tong 44 attachment surface 48. The U-shaped plate 72 can also include a bottom surface 73 (opposite the top surface 71). U-shaped retention feature 74 can be attached to the bottom surface 73 with a center axis of both the U-shaped plate 72 and the retention feature 74 aligned with the center axis 80. The U-shaped retention feature 74 can have an L-shaped cross-section that forms a U-shaped channel 78 when the retention feature 74 is attached to the bottom surface 73 of the U-shaped plate 72. The retention feature 74 can include a left portion 74*a*, a back portion 74*b*, and a right portion 74*c*. The left and right portions 74*a*, 74*c* are straight portions of the U-shape with the back portion 74*b* being a curved portion of the U-shape having an inner radius R2 and an outer radius R4. The U-shaped channel 78 can have an inner radius R3. Since the retention ring 118 is to be inserted into the U-shaped channel 78, the inner radius R3 can be larger than the outer radius R8 of the retention ring 118. However, the inner radius R2 of the U-shaped channel 78 is smaller than the outer radius R8 of the retention ring 118 to retain the retention ring 118 within the U-shaped channel 78. The width of the opening 76 can be seen as 2 times R1.

Figure 8A:
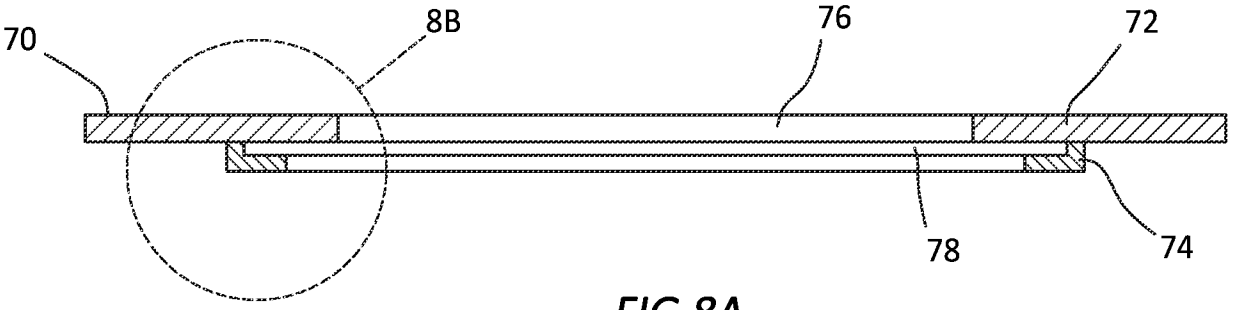
FIG. 8A is a representative end view of an interface structure that removably attaches a mud bucket to a backup tong of an iron roughneck, in accordance with certain embodiments.
Figure 8B:
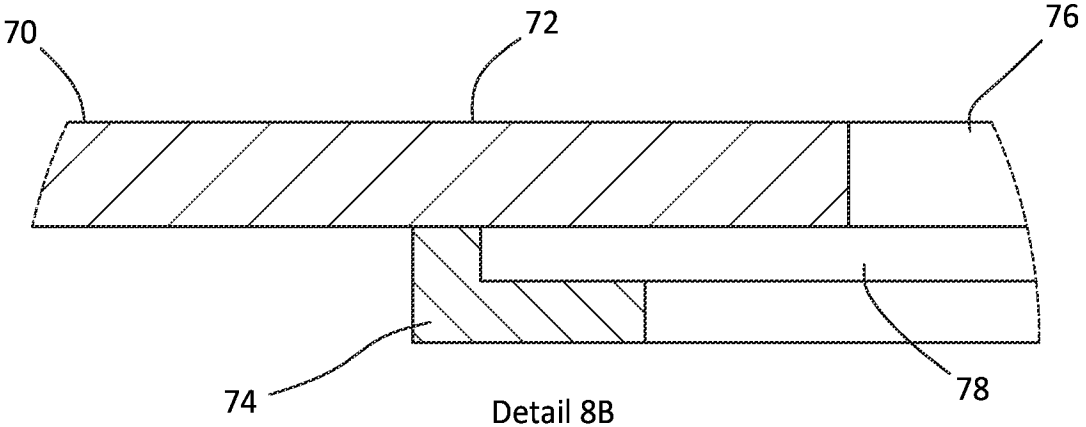
FIG. 8B is a detailed view of section 8B of the interface structure in FIG. 8A, in accordance with certain embodiments.

FIG. 8A is a representative end view of an interface structure 70 that removably attaches a mud bucket 100 to a backup tong 44 of an iron roughneck 38. FIG. 8B is a detailed view of section 8B of the interface structure 70 in FIG. 8A. FIG. 8A shows the end view of the interface structure 70 with U-shaped retention feature 74 attached to the U-shaped plate 72, thereby forming the U-shaped channel 78. FIG. 8B shows the detailed view of the L-shaped cross-section retention feature 74 attached to the U-shaped plate 72 to form channel 78.

Figure 9:
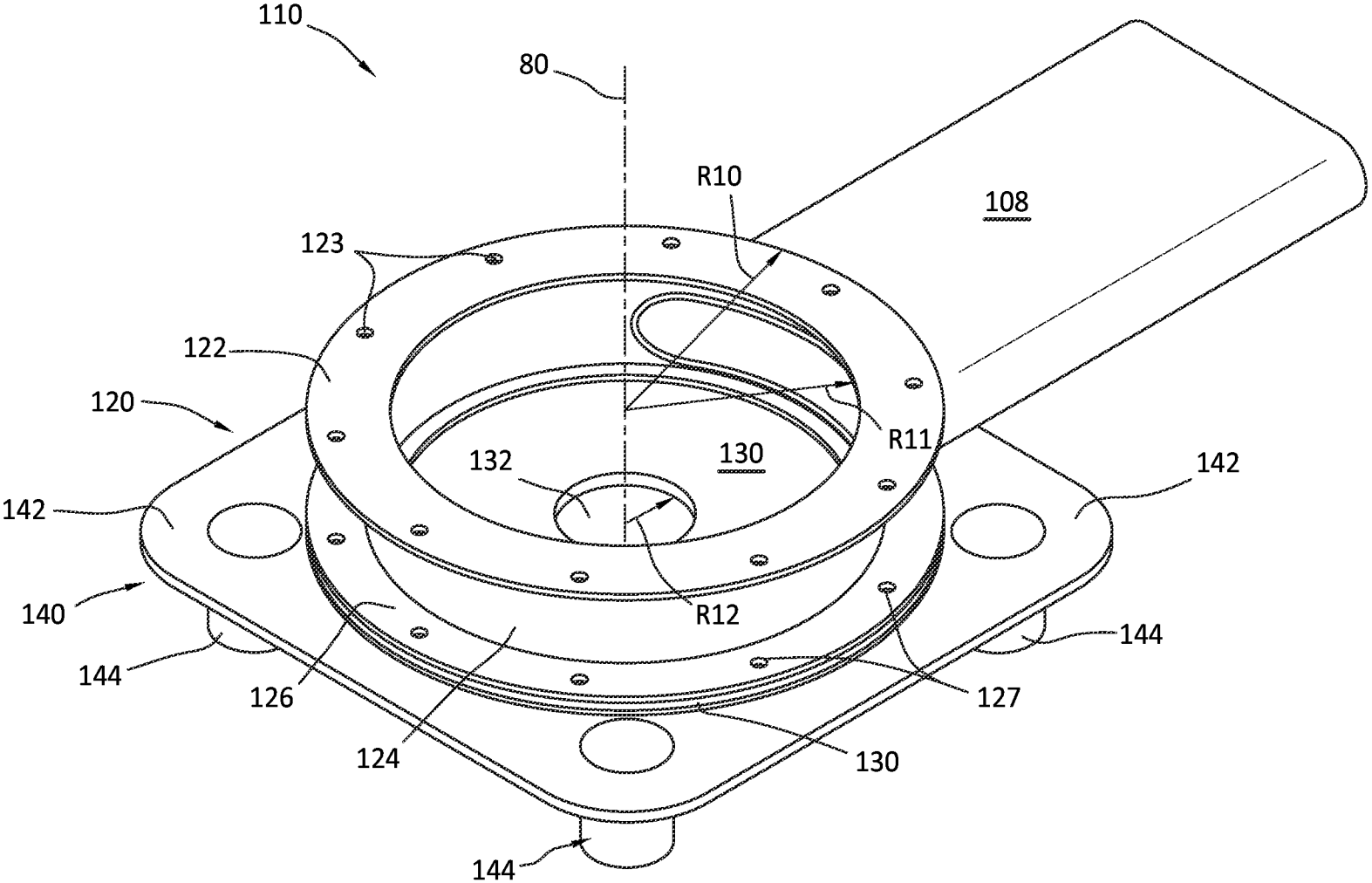
FIG. 9 is a representative perspective view of a base structure that can be connected to the bottom end of the bellows used in the mud bucket, in accordance with certain embodiments.

FIG. 9 is a representative perspective view of a base structure 110 that can be connected to the bottom end 106 of the bellows 102 of the mud bucket 100. The base structure 110 can include a cylindrically shaped interface chamber 120 with the center axis 80, a seal 130, and a slip interface structure 140. The interface chamber 120 can include an upper flange 122, a lower flange 126, and a cylindrical body 124 which is connected between the flanges 122, 126. A drain port 108 can be attached to the cylindrical body 124 forming an opening through a wall of the cylindrical body 124 through which expelled fluid can flow. The drain port 108 can be any shape, but the currently illustrated elongated oval cross-section may provide increased flow area for the expelled fluids when trying to minimize the height of the base structure 110.

The upper flange 122 can have an inner radius R11 and an outer radius R10. The inner radius R11 should be large enough to allow for an annulus volume between the tubular 54 or tubular string 58 and the inner surfaces of the bellows 102. The annulus volume should be sized to allow for the desired fluid flow of the expelled fluids from the tubular 54. Holes 123 can be circumferentially spaced around the flange 122 and arranged in a pattern that matches a hole pattern in the attachment ring 116. Fasteners can be inserted through each hole 123 in the flange 122 and a respective hole in the attachment ring 116 to secure the attachment ring 116 to the cylindrically shaped interface chamber 120.

Holes 127 can be circumferentially spaced around the flange 126 and arranged in a pattern that matches a hole pattern in the slip interface structure 140. Fasteners can be inserted through each hole 127 in the flange 126 and a respective hole in the slip interface structure 140 to secure the cylindrically shaped interface chamber 120 to the slip interface structure 140. A seal 130 can be disposed between the flange 126 and the slip interface structure 140, such that when the interface chamber 120 is secured to the slip interface structure 140, the seal is secured between them. The seal 130 is configured to expand to allow tubulars (including radially enlarged pin and box ends) to be pulled vertically through the base structure 110 while remaining sealingly engaged with an outer surface of the tubular 54.

The seal 130 is configured to prevent (or minimize) expelled fluid from flowing out of the interface chamber 120 and onto the rig floor 16. The seal 130 urges the fluid to exit the interface chamber 120 via the drain port (or plenum) 108. The seal 130 can have a center opening 132 with an inner radius of R12, such that R12 is sized to provide sealing engagement with the smallest diameter tubular 54 to be inserted through the opening 132. The seal 130 can be formed from one or more layers of resilient material that can allow the center opening 132 to expand to accommodate larger diameter tubulars 54 while also able to provide sealing engagement with smaller diameter tubulars 54. The seal 130 can also be formed from a plurality of arcuate segments, with the arcuate segments forming two layers with the segments in the top layer overlapping the gaps between adjacent segments in the bottom layer. The seal 130 can be made from a resilient material (e.g., rubbers, elastomers, polymers, etc.) or combinations of resilient materials. The seal 130 can have a fixed opening 132 or the seal 130 can be actuated to engage or disengage the tubular string 58, with an actuator selectively moving the seal 130 into and out of engagement with the tubular string 58. When disengaged from the tubular string 58, a connection 56 of the tubular string 58 can pass through the mud bucket 100 with less resistance.

The slip interface structure 140 can include a plate 142 with pegs 144 protruding below the plate 142. The pegs 144 can be configured to match bit breaking recesses in the slips 60 (or other equipment). The bit breaking recesses can be used to hold a fixture for torquing or untorquing a bit on a drill string 58. When the base structure 110 is placed on the slips 60, the pegs 144 can be inserted into the bit breaking recesses to minimize lateral or rotational motion of the slip interface structure 140 relative to the slips 60. The weight of the base structure 110 can keep the pegs 144 inserted into the bit breaking recesses, but a removable latch (not shown) can also be installed to actively hold the slip interface structure 140 to the slips 60 during operations. Alternatively, or in addition to, the slips 60 (or other equipment) can actively retain the pegs 144 within the bit breaker recesses.

Figure 10:
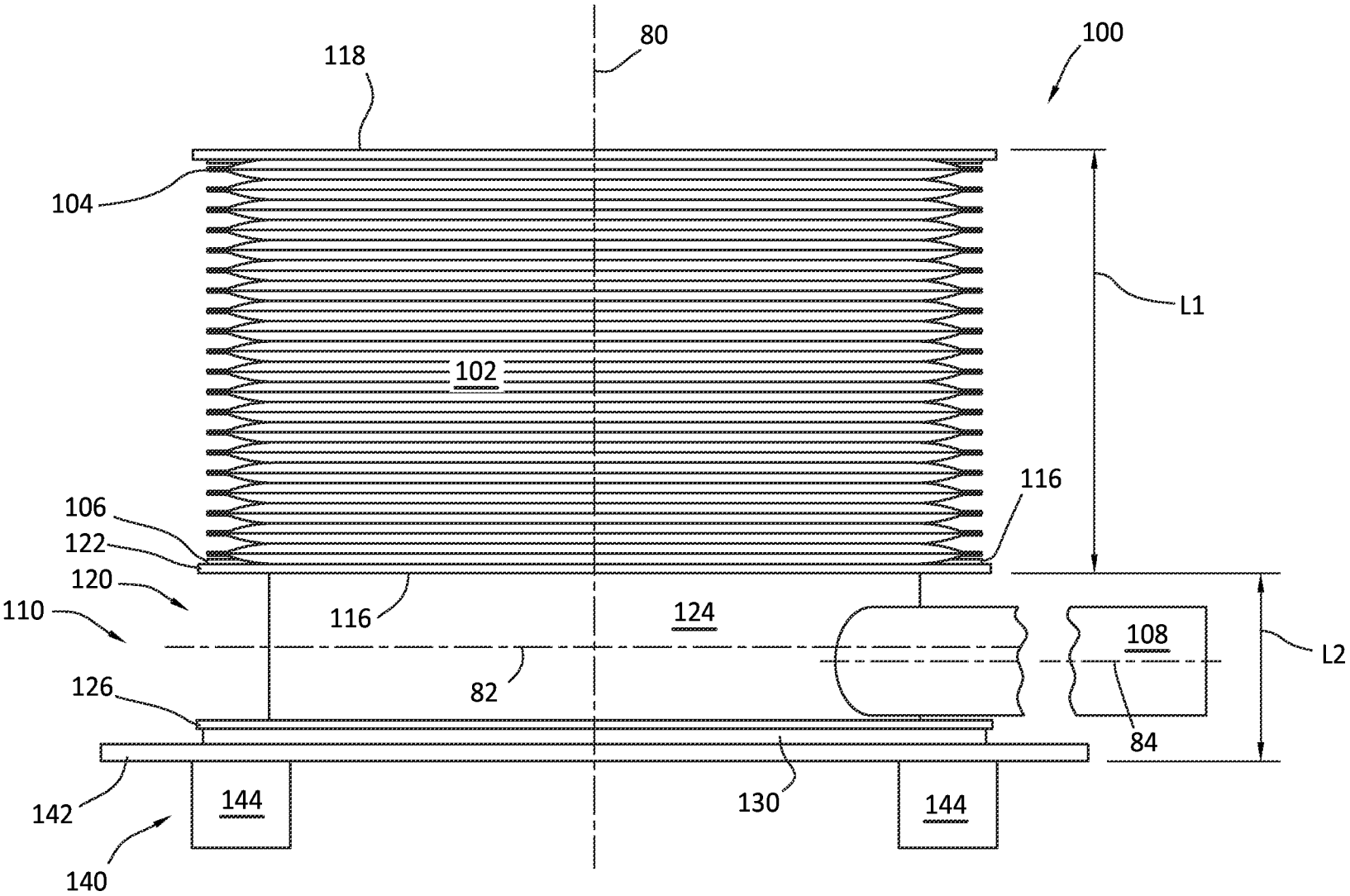
FIG. 10 is a representative perspective side view of a mud bucket, in accordance with certain embodiments.

FIG. 10 is a representative perspective side view of the mud bucket 100. The mud bucket 100 can have a center longitudinal axis 80 that is a common center axis for the retention ring 118, the bellows 102, the attachment ring 116, cylindrically shaped interface chamber 120, the seal opening 132, and the slip interface structure 140. The retention ring 118 can be inserted into the U-shaped channel 78 in the interface structure 70 that can be attached to the backup tong 44 (or other equipment). The retention ring 118 can be attached to the upper end 104 of the bellows 102, with the attachment ring 116 attached to the lower end 106 of the bellows 102. The attachment ring 116 can be attached (via fasteners) to the flange 122 of the base structure 110. The flange 126 of the base structure 110 can be attached to the plate 142 with the seal 130 disposed between the flange 126 and the plate 142. The mud bucket 100 requires a clearance above the slips 60 (or other equipment) of height L2 plus the shortest height L1 of the bellows 102 when the bellows 102 are fully collapsed. The height L2 does not include the pegs 144 because the pegs 144 will be received into the bit breaker recesses when the mud bucket 100 is installed at well center 24.

The drain port 108 can have a center horizontal axis 84 that can be offset from the center horizontal plane 82 of the cylindrical body 124. The drain port 108 can be offset toward the bottom flange 126 to minimize a volume above the seal 130 that can hold expelled fluids. However, the drain port 108 is not required to be offset toward the bottom flange 126. The drain port 108 can be offset toward the upper flange 122 or it can be aligned with the plane 82.

The equipment mentioned in the discussion below of the operation of the mud bucket 100 are for discussion purposes only. The mud bucket 100 can be used with any other suitable equipment other than the equipment mentioned.

In a non-limiting embodiment, the iron roughneck 38 (or other equipment) can be moved to well center 24 in preparation for tripping out a tubular string 58 from the wellbore 15. With the base structure 110 mounted onto the slips 60 (or other equipment), the retention ring 118 can be inserted into the U-shaped channel 78 attached to the backup tong 44. With the retention ring 118 in the U-shaped channel 78, raising the backup tong 44 will expand the bellows 102 (i.e., lengthen height L1), and lowering the backup tong 44 will collapse the bellows 102 (i.e., reduce height L1).

With a top drive (not shown) engaged with the tubular, it can be pulled from the wellbore 15 until a connection is positioned proximate the iron roughneck 38 for untorquing the connection. As the backup tong 44 is moved up or down to align with the bottom portion of the connection, the bellows expand or collapse as needed to move with the backup tong 44. After the iron roughneck 38 untorques the connection, the backup tong 44 can be raised up above the untorqued connection to expand the bellows 102 past the connection thereby providing a generally cylindrically column that extends from the base structure 110 to the backup tong 44 (which is raised above the connection). The top drive (or another pipe handler, spinner, etc.) can be used to further unthread the connection to release the tubular 54 from the end of the tubular string 58 and thus release any fluids contained within the tubular 54. As the fluids are expelled from the tubular 54, the fluids will flow down through an annulus volume formed between the bellows 102 and the tubular 54 (or tubular string 58) toward the base structure 110. The expelled fluid will be directed to the drain port 108 by the seal 130 and the interface chamber 120. With the drain port coupled to a drain hose 112, the expelled fluid can flow through the hose 112 to a collection chamber 114.

With the majority of the expelled fluid drained away to the collection chamber 114, the backup tong 44 can be lowered to collapse the bellows 102 in preparation for disconnecting another connection in the tubular string 58 as the tubular string is tripped out of the wellbore 15.

In a non-limiting embodiment, the bellows 102 can remain connected to the backup tong 44 while multiple connections are disconnected and the tubulars 54 removed from the tubular string 58. When it is determined that the seal 130, the bellows 102, or any other part of the mud bucket 100 are worn to a point of needing repair, the mud bucket 100 assembly can be removed from the well center 24 by removing the retention ring 118 from the U-shaped channel 78, disconnecting the drain hose 112 from the drain port 108 and lifting the mud bucket 100 from the slips 60 and over the stump of the drill string 58. The replacement mud bucket 100 (with any consumable components replaced) can then be just as easily installed by placing the mud bucket 100 over the stump and onto the slips 60, engaging the pegs 144 with the bit breaker recesses, and inserting the retention ring 118 into the U-shaped channel 78. A retention feature can also be included to actively secure the retention ring 118 in the U-shaped channel 78, but the retention feature is not required.

In a non-limiting embodiment, the bellows 102 can be connected and disconnected from the backup tong 44 allowing the iron roughneck 38 to move away from well center 24 between each connection disconnection process. Each time the iron roughneck 38 moves away from the well center 24, the retention ring 118 will be removed from the U-shaped channel 78. When the iron roughneck 38 moves back to well center 24, the retention ring 118 will again be inserted into the U-shaped channel 78 to again couple the top of the bellows 102 with the backup tong 44. Therefore, for each connection to be disconnected, the iron roughneck 38 can move to well center 24, insert the retention ring 118 into the U-shaped channel 78, untorque the connection, expand the bellows past the connection, a pipe handler can remove the tubular 54 and expel the fluids from the tubular 54 into the mud bucket 100, the mud bucket 100 can drain the expelled fluids through the drain port into the collection chamber 114, the iron roughneck 38 can disengage the retention ring 118 from the U-shaped channel 78, and then the iron roughneck 38 can move away from well center 24. This process can be repeated for each connection that is disconnected during the tripping out process.

Figure 11:
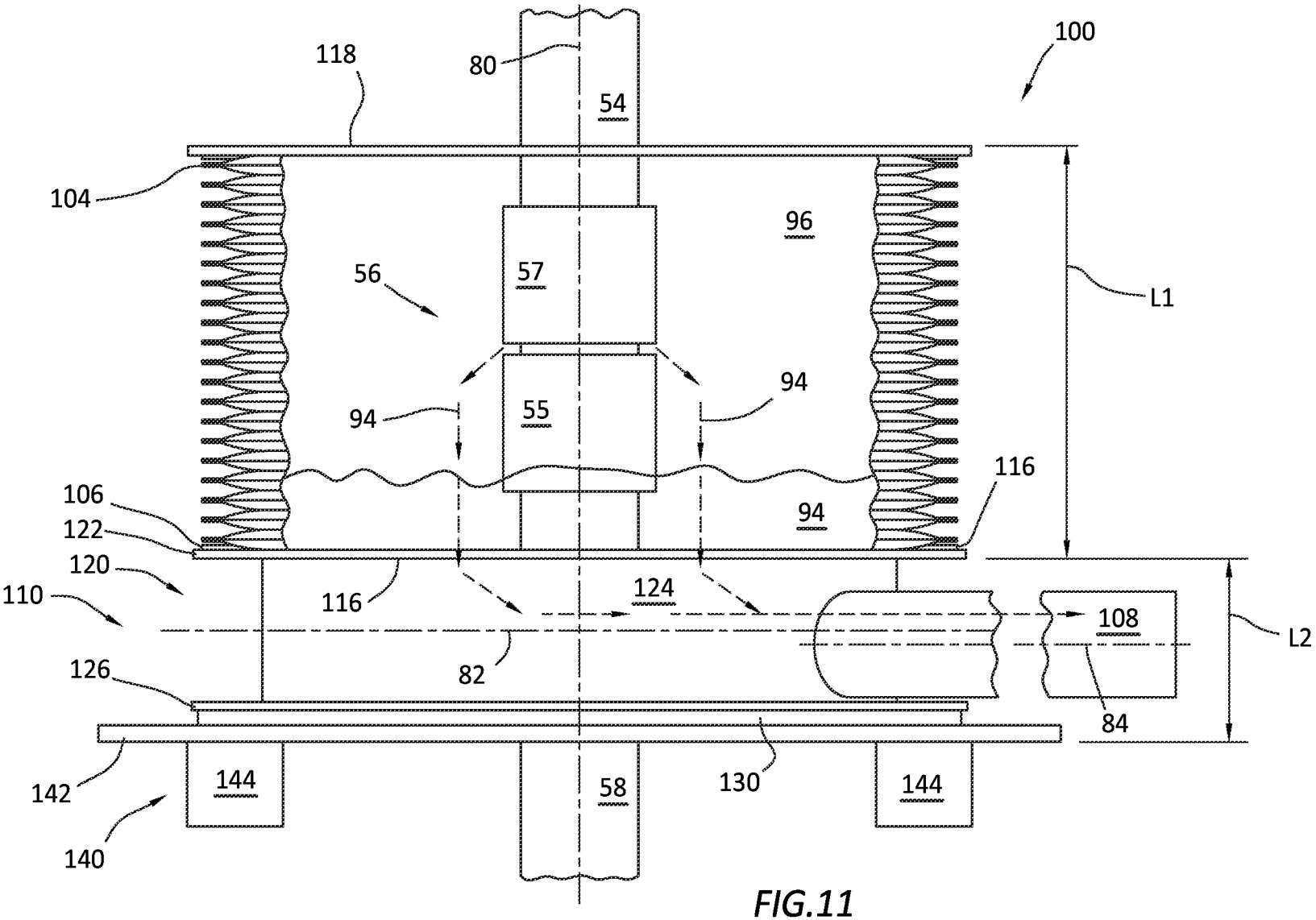
FIG. 11 is a representative partial cross-sectional side view of a mud bucket with flow paths indicated, in accordance with certain embodiments.

FIG. 11 is a representative partial cross-sectional side view of a mud bucket 100 with flow paths of the expelled fluid 94 indicated. When the connection 56 (i.e., the threaded connection of the pin end 57 to the box end 55) is positioned within the longitudinal internal chamber 96 (or longitudinal internal cavity 96) after the connection 56 has been untorqued by a torque wrench 42 and backup tong 44, a pipe handler can be used to unthread the pin end 57 from the box end 55 to complete the disconnection of the tubular 54 from the tubular string 58. As the pin end 57 is being unthreaded from the box end 55, fluid 94 contained within the tubular 54 can be released (or expelled) from the tubular 54 as shown by arrows indicating the flow of the fluid 94. The fluid 94 can also collect at the bottom of the mud bucket 100 (e.g., just above the seal 130) as the fluid 94 is flowing from the tubular 54. The fluid 94 can flow downward (via gravity) through the longitudinal internal cavity 96, into and through the interface chamber 120, and out through the drain port 108. This allows the fluid 94 to be removed from the well center and minimizes spillage of the fluid 94 as the tubular string 58 is being tripped out of the wellbore.

Figure 12:
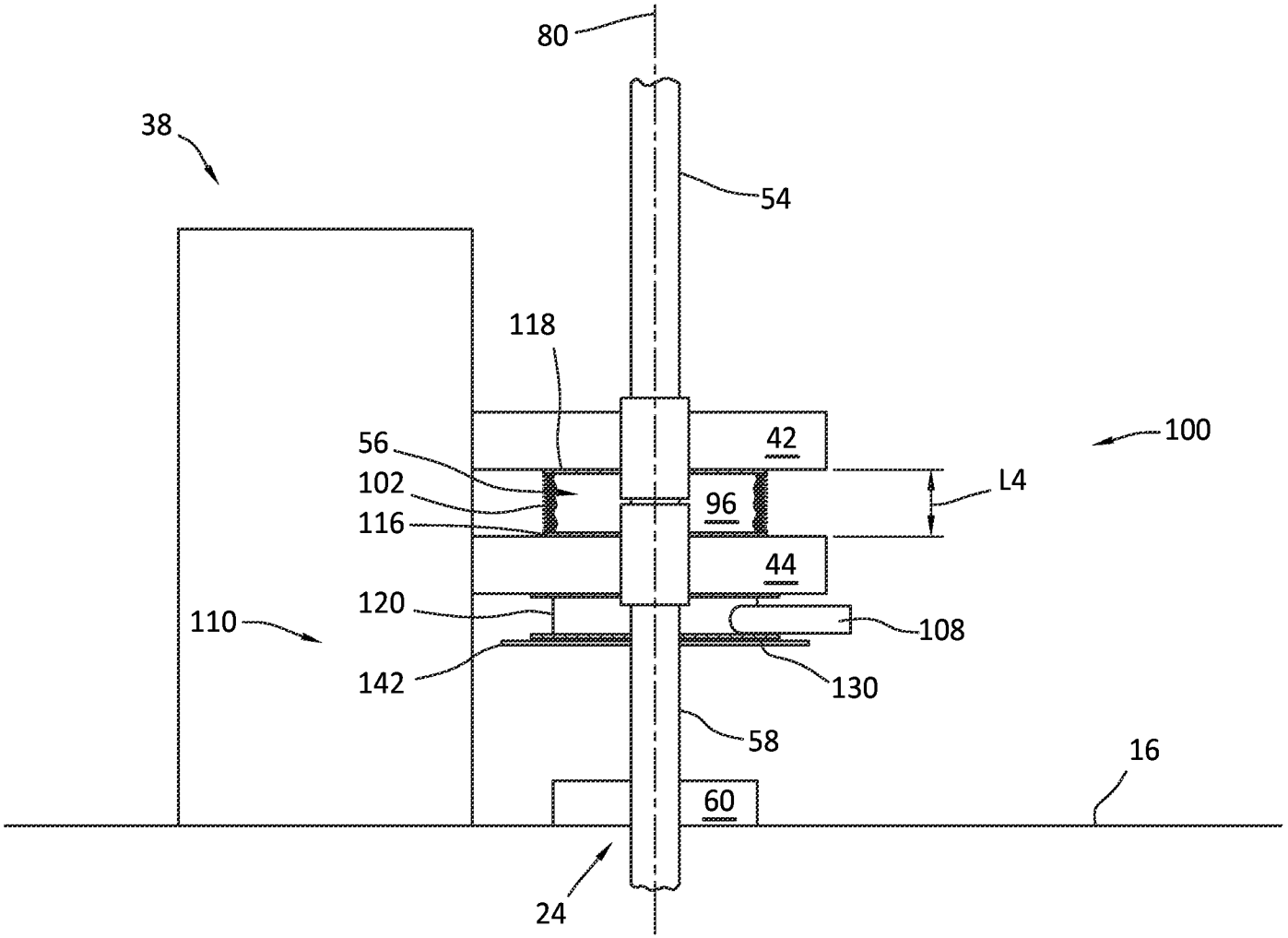
FIG. 12 is a representative partial cross-sectional side view of an iron roughneck with an integral mud bucket, in accordance with certain embodiments.

In a non-limiting embodiment, FIG. 12 is a representative partial cross-sectional side view of a mud bucket 100 that can be integral to the iron roughneck 38. The torque wrench 42 and backup tong 44 have been positioned adjacent to a connection in a tubular string 58 between a pin end 57 of a tubular 54 and a box end 55 of a stump of the tubular string 58. The backup tong 44 can engage the box end 55 to prevent rotation of the tubular string 58, and the torque wrench 42 can engage the pin end 57 of the tubular 54 to untorque the connection 56 by rotating the tubular 54 relative to the tubular string 58. An expandable bellows 102 has been positioned between the backup tong 44 and the torque wrench 42 to capture expelled fluid from the tubular 54 when the connection 56 is unthreaded. The attachment ring 116 of the bellows 102 can be coupled to the top of the backup tong 44, with the other end (i.e., the retention ring 118) coupled to the bottom of the torque wrench 42 and the tubular string 58 can be extended through the internal cavity 96 of the bellows 102. In this configuration, the base structure 110 can be coupled to the bottom of the backup tong 44 to receive expelled fluids from the internal cavity 96. The expelled fluid can be directed to the drain port 108 via the seal 130 as described above, with a drain hose 112 coupled to the drain port 108 to carry the expelled fluid away from the well center 24.

Figure 13:
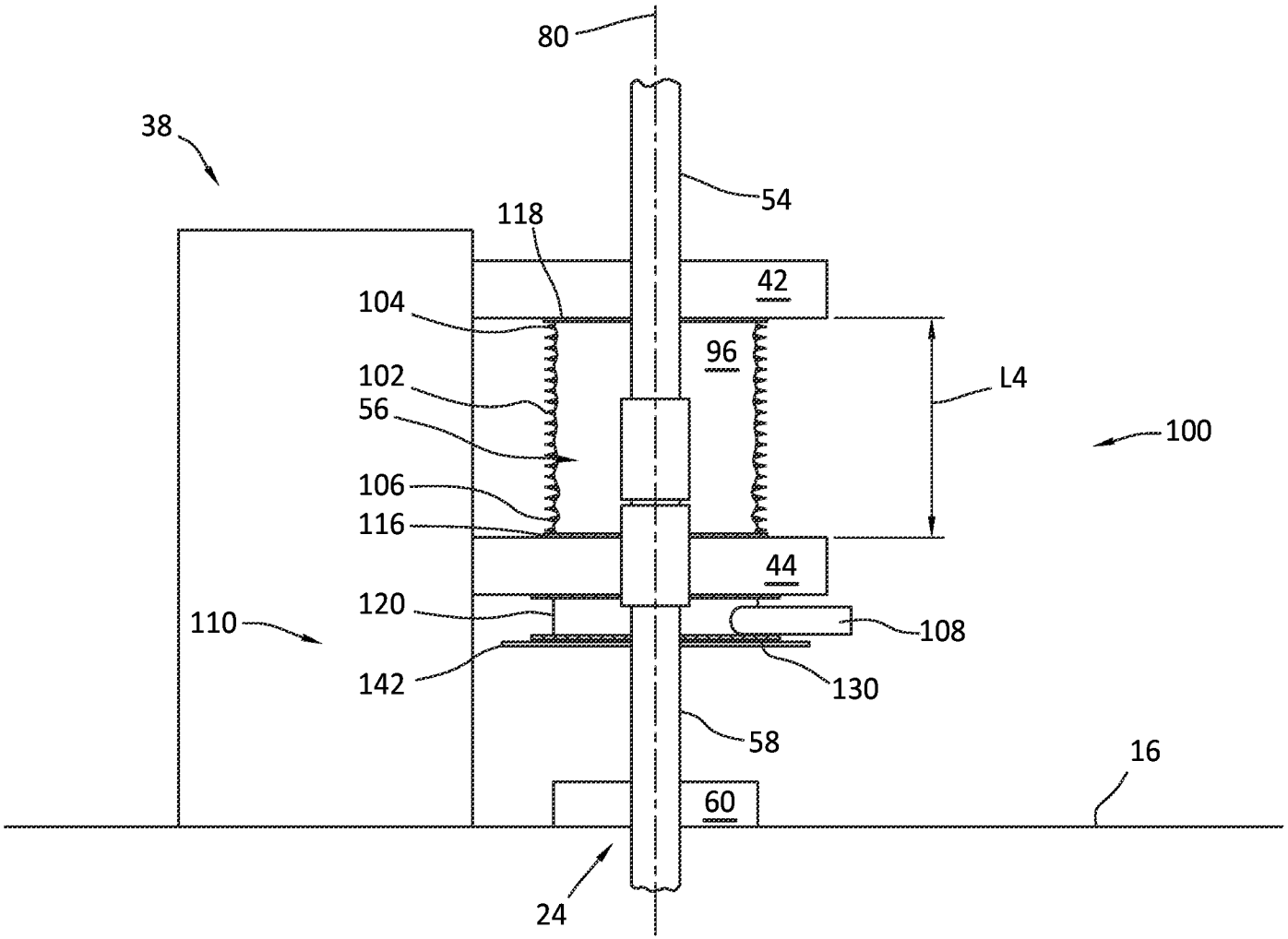
FIG. 13 is a representative partial cross-sectional side view of an iron roughneck with an expanded integral mud bucket, in accordance with certain embodiments.

In a non-limiting embodiment, FIG. 13 is a representative partial cross-sectional side view of the mud bucket 100 of FIG. 12 with the mud bucket expanded to capture the expelled fluid when the tubular connection is unthreaded. The backup tong 44 can remain engaged with the box end 55 of the tubular string 58 while the torque wrench 42 can be disengaged from the pin end 57 of the tubular 54 and raised to increase the height L4 of the bellows 102, thereby extending the bellows upward past the tubular connection 56. As illustrated, the retention ring 118 (at the end 104 of the bellows 102) can be coupled to the bottom of the torque wrench 42 with the attachment ring 116 (at the end 106 of the bellows 102) coupled to the top of the backup tong 44. When the vertical movement of the torque wrench 42 expands the bellows 102 the desired distance (height L4), a pipe handler (not shown) can further spin out (unthread) the pin end 57 from the box end of the connection 56, thereby expelling fluid from the tubular 54 into the internal cavity 96. As described above, the fluid expelled from the tubular 54 into the internal cavity 96 can flow down the internal cavity 96 through the backup tong 44 and into the base structure 110 coupled to the bottom of the backup tong 44. The seal 130 can divert the expelled fluid to the drain port 108 to flow the fluid away from the well center 24.

Figure 14A:
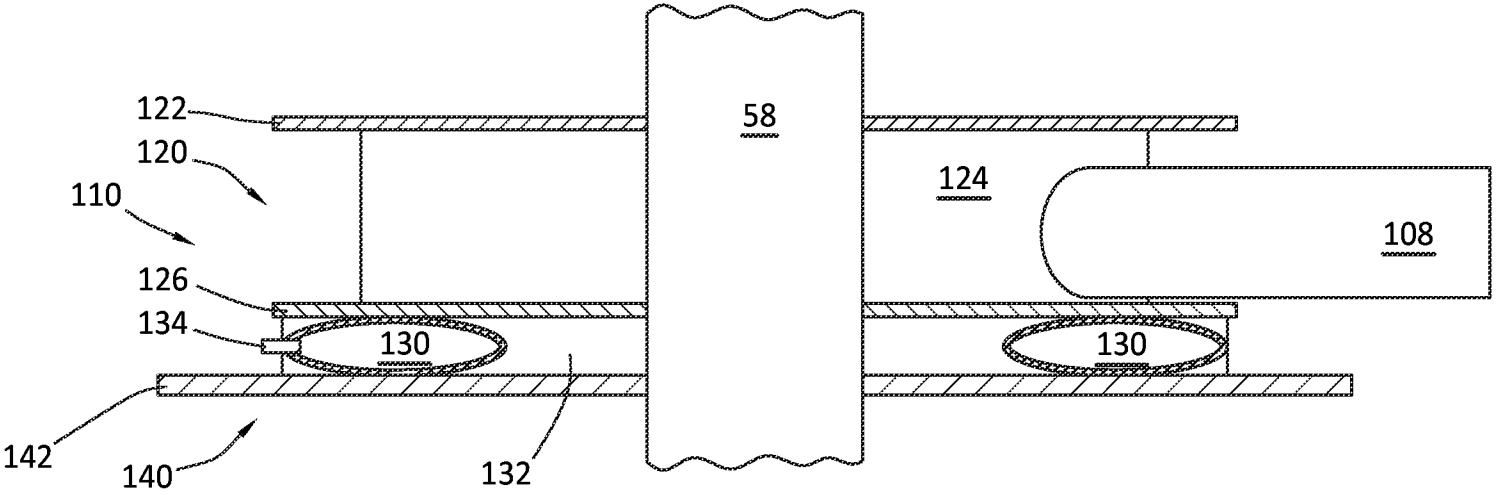
FIGS. 14A-14B are representative partial cross-sectional side views of an inflatable seal for an expandable mud bucket, in accordance with certain embodiments.
Figure 14B:
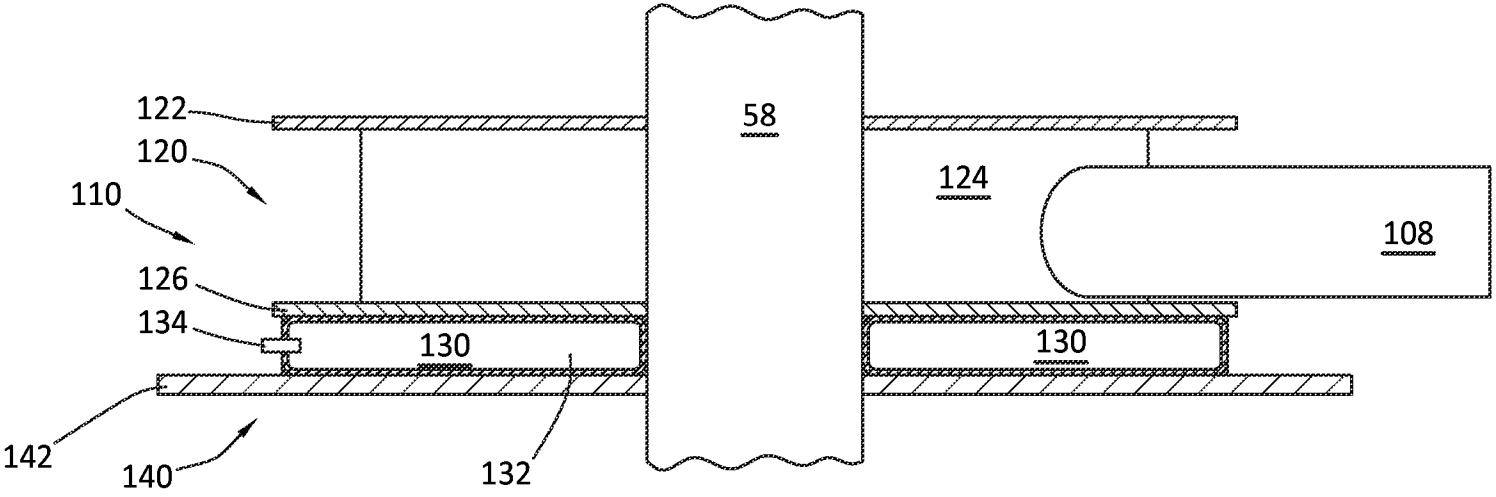

In a non-limiting embodiment, FIGS. 14A-14B are representative partial cross-sectional side views of an inflatable seal 130 for an expandable/collapsible mud bucket 100. FIG. 14A shows a tubular string 58 extending through the base structure 110 that can include the interface chamber 120, the seal 130, and the interface structure 140. The upper flange 122 of the interface chamber 120 can be coupled to the bottom of the backup tong 44 and the lower flange 126 can be coupled to the seal 130, which can be used to selectively sealingly engage/disengage with the tubular string 58. The seal 130 can be positioned between the plate 142 of the interface structure 140 and the interface chamber 120. The seal 130 can comprise an inflatable bladder with a fluid inlet 134, the seal 130 forming an opening 132 in the center of the bladder. As fluid (e.g., gas or liquid) is input into the bladder via the inlet 134, the seal 130 can expand into sealing engagement with the tubular string 58 (see FIG. 14B). This sealing engagement can minimize portions of the expelled fluid that enter the interface chamber 120 from passing down between the seal and the tubular string 58. The expandable seal 130 can direct the expelled fluid that enters the interface chamber 120 to the drain port 108. After the expelled fluid is diverted away from the well center 24, then the fluid in the bladder can be allowed to flow out of the bladder through the inlet 134, thereby deflating the bladder and disengaging the seal 130 from the tubular string 58. This allows the seal 130 to engage/disengage the tubular string 58 as needed.

Figure 15:
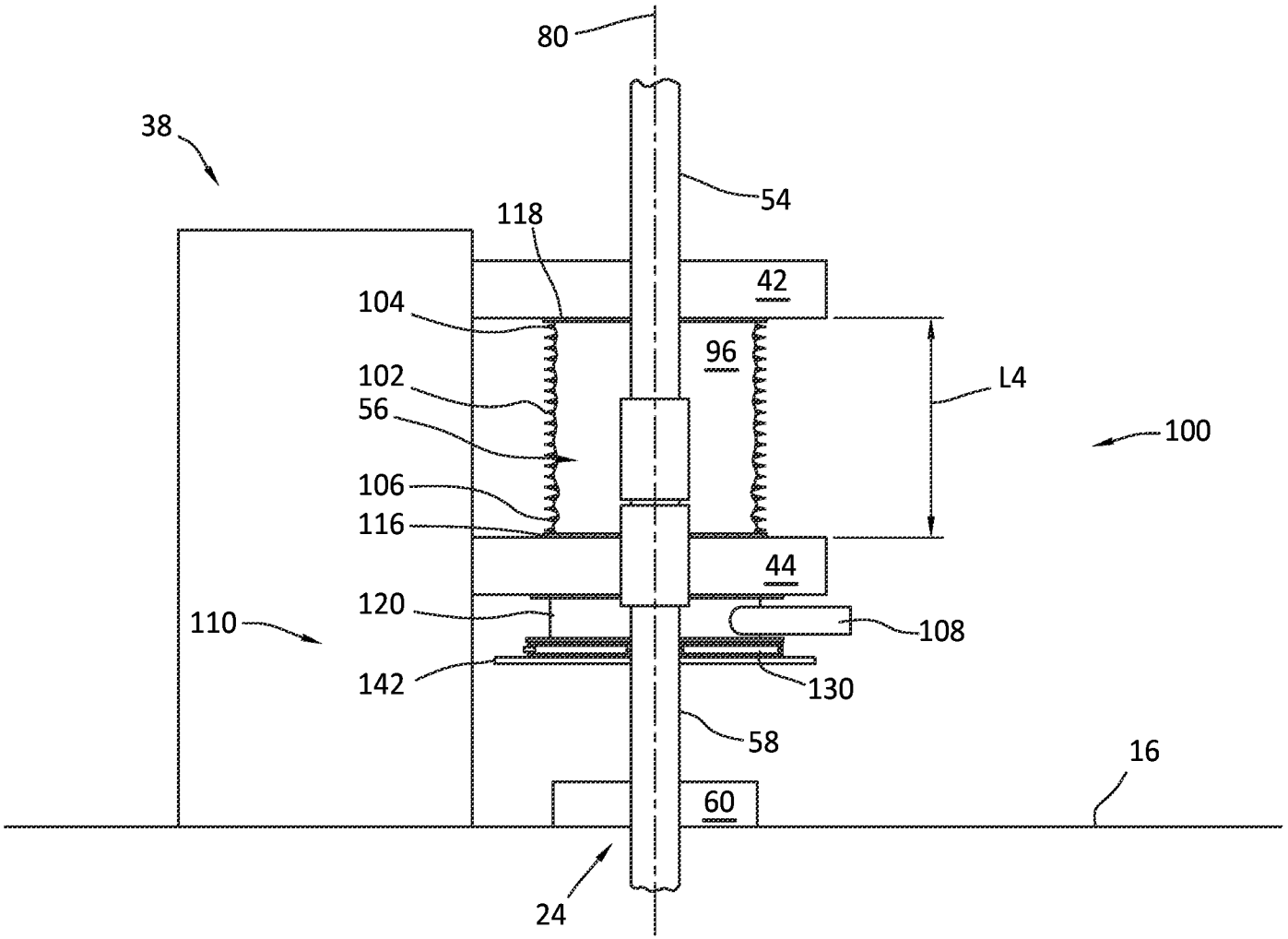
FIG. 15 is a representative partial cross-sectional side view of an iron roughneck with an integral mud bucket, in accordance with certain embodiments.

In a non-limiting embodiment, FIG. 15 is a representative partial cross-sectional side view of an iron roughneck 38 with an integral mud bucket 100. After the connection 56 is untorqued, the backup tong 44 can remain engaged with the box end 55 of the tubular string 58 while the torque wrench 42 can be disengaged from the pin end 57 of the tubular 54 and raised to increase the height L4 of the bellows 102, thereby extending the bellows upward past the tubular connection 56. As illustrated, the retention ring 118 (at the end 104 of the bellows 102) can be coupled to the bottom of the torque wrench 42 with the attachment ring 116 (at the end 106 of the bellows 102) can be coupled to the top of the backup tong 44. When the vertical movement of the torque wrench 42 expands the bellows 102 the desired distance (height L4), a pipe handler (not shown) can further spin out (unthread) the pin end 57 from the box end of the connection 56, thereby expelling fluid from the tubular 54 into the internal cavity 96. As described above, the fluid expelled from the tubular 54 into the internal cavity 96 can flow down the internal cavity 96 through the backup tong 44 and into the base structure 110 coupled to the bottom of the backup tong 44. The seal 130 can be inflated to engage the tubular 58 and can divert the expelled fluid to the drain port 108 to flow the fluid away from the well center 24.

Figure 16A:
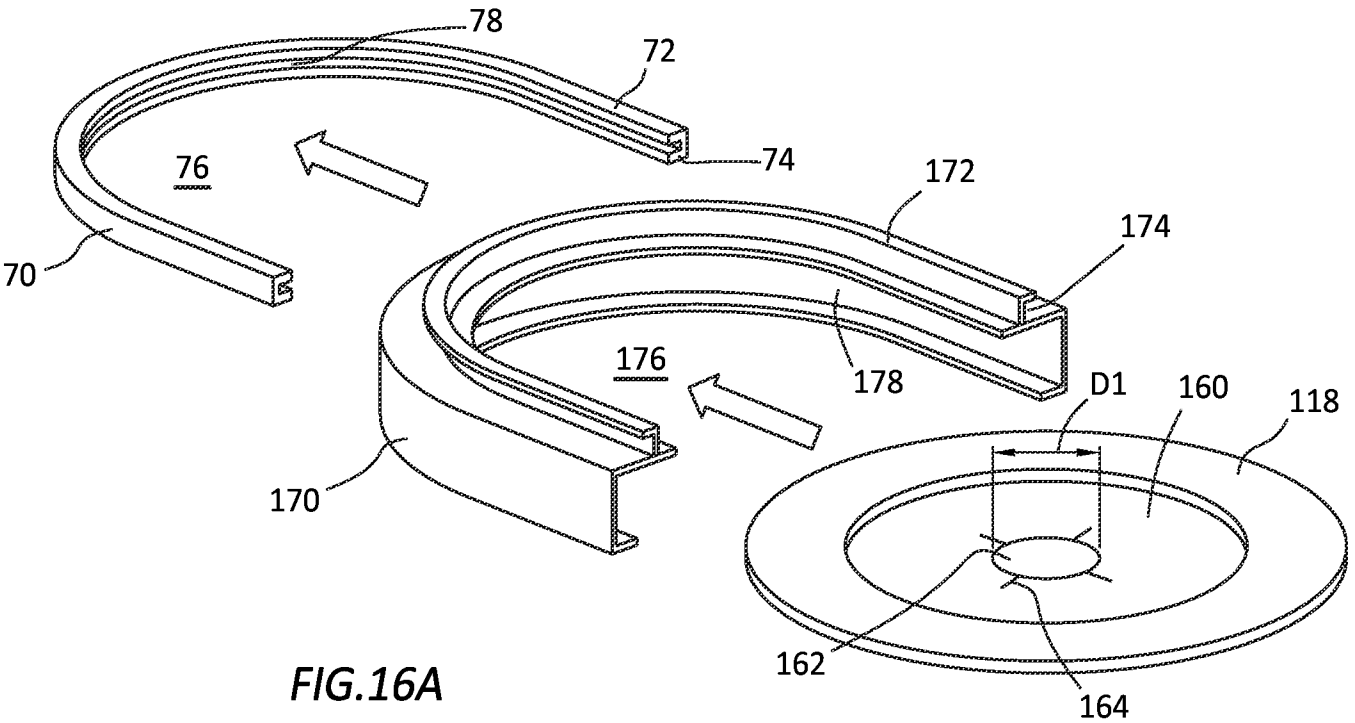
FIG. 16A is a representative perspective exploded view of an interface adapter engaging the interface structure and removably engaging with a retention ring of the mud bucket, in accordance with certain embodiments.

In a non-limiting embodiment, FIG. 16A is a representative perspective exploded view of an interface adapter 170 engaging the interface structure 70 and removably engaging with a retention ring 118 of the mud bucket 100. The retention ring 118 can include an inner seal 160 that can receive a tubular 54 or tubular string 58 through the opening 162 and sealingly engage the tubular 54 or tubular string 58. In a non-limiting embodiment, the inner seal 160 can be made from a resilient material with an opening 162 formed in the resilient material. The inner seal 160 can also have slits 164 formed in the resilient material and radially extending from the opening 162. The slits 164 can allow for easier enlargement of the diameter D1 of the opening 162 to accommodate large tubulars or enlarged pin or box ends of tubulars 54.

In a non-limiting embodiment, the interface structure 70 can be attached to a bottom side of a backup tong 44. An interface adapter 170 can be removably engaged with the interface structure 70 by inserting a U-shaped attachment interface 172 of the interface adapter 170 into the U-shaped channel 78 of the interface structure 70. When the interface adapter 170 is installed in the interface structure 70, the U-shaped interface adapter 170 can form an opening 176. With the interface structure 70 attached to the backup tong 44 via the attachment interface 72 and the interface adapter 170 engaged with the U-shaped channel 78, the backup tong 44 can be moved toward the retention ring 118 to engage the retention ring 118 in a U-shaped channel 178 or moved away from the retention ring 118 to disengage the retention ring 118 from the U-shaped channel 178.

When the retention ring 118 is engaged in the U-shaped channel 178, raising and lowering the backup tong 44 will raise and lower the retention ring 118, thereby expanding or contracting the bellows 102 of the mud bucket 100. In this embodiment, the U-shaped channel 178 is deeper than the U-shaped channel 78 and allows for easier alignment and insertion of the retention ring 118 into the U-shaped channel 178. Therefore, the iron roughneck 38 can be easily moved away from well center 24 (by disengaging the U-shaped channel 178 from the retention ring 118) and moved back to the well center 24 (by again engaging the U-shaped channel 178 to the retention ring 118) as each joint of the tubular string 58 is raised from the wellbore 15 to be disconnected during tripping the tubular string 58 from the wellbore 15.

Figure 16B:
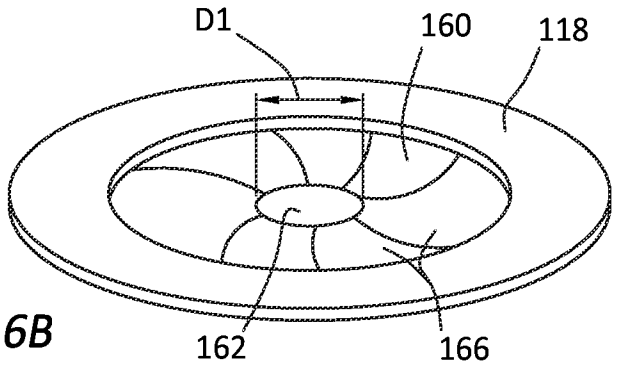
FIG. 16B is a representative perspective view of a retention ring with an inner seal for sealing around a tubular, in accordance with certain embodiments.

In a non-limiting embodiment, FIG. 16B is a representative perspective view of a retention ring 118 with an inner seal 160 for sealing around a tubular 54 or tubular string 58. In this embodiment of the retention ring 118, the inner seal 160 is made up of arcuate segments 166 that can be moved to increase or decrease the diameter D1 of the opening 162. Therefore, the inner seal 160 can be actuated to move the segments 166 to enlarge the opening 162 or reduce the opening 162 as needed to allow movement of the tubular string 58 (and associated joints) through the seal 160. In a non-limiting embodiment, the arcuate segments 166 can be stationary segments that overlap at least a portion of each neighboring segment 166.

Figure 17:
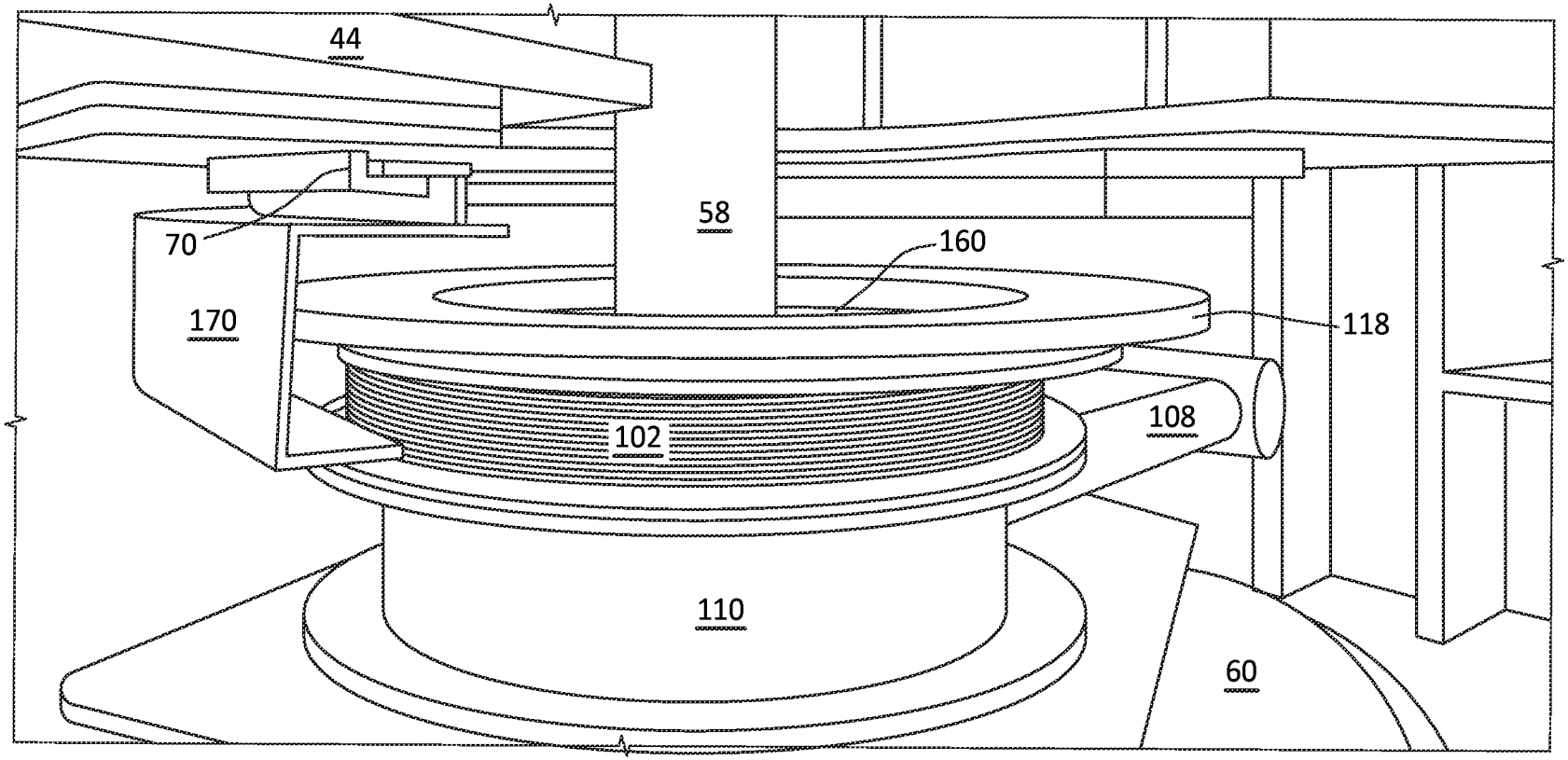
FIG. 17 is a representative perspective view of a mud bucket with a collapsed bellows and in position to engage with an iron roughneck, in accordance with certain embodiments.

In a non-limiting embodiment, FIG. 17 is a representative perspective view of a mud bucket 100 with a collapsed bellows 102 and being in a position to engage with a backup tong 44 of an iron roughneck 38. When the retention ring 118 is lowered to collapse the bellows 102, the retention ring 118 can rest on the collapsed bellows 102 as the backup tong 44 is moved away from well center 24 (i.e., disengaging from the retention ring 118) and then again moved back to well center 24 (i.e., engaging the retention ring 118 with the interface adapter 170. The weight of the retention ring 118 can be used to set down on the bellows 102 and remain stable at well center 24 until the backup tong 44 is moved back to the well center 24. As described previously, when the backup tong 44 is at well center 24 and the retention ring 118 is received by the interface adapter 170, raising the backup tong 44 will expand the bellows 102, and lowering the backup tong 44 will collapse the bellows 102.

Figure 18A:
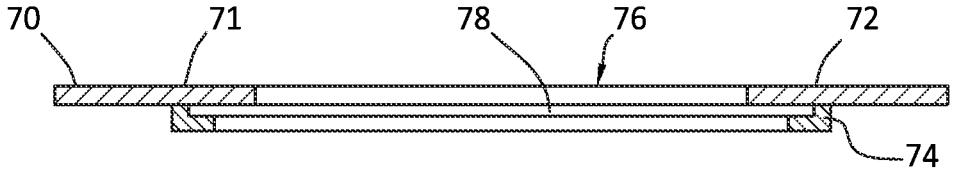
FIG. 18A is a representative partial cross-section end view of the interface structure which can be mounted to an iron roughneck to interface with a collapsible mud bucket, in accordance with certain embodiments.
Figure 18B:
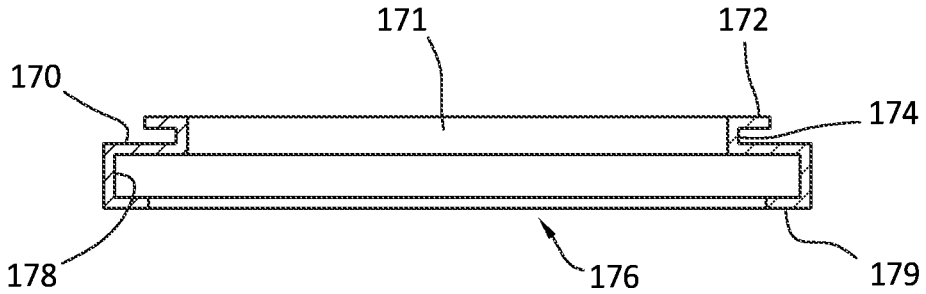
FIG. 18B is a representative partial cross-section end view of the interface adapter which can be used to adapt the interface structure of FIG. 18A to a collapsible mud bucket, in accordance with certain embodiments.
Figure 18C:
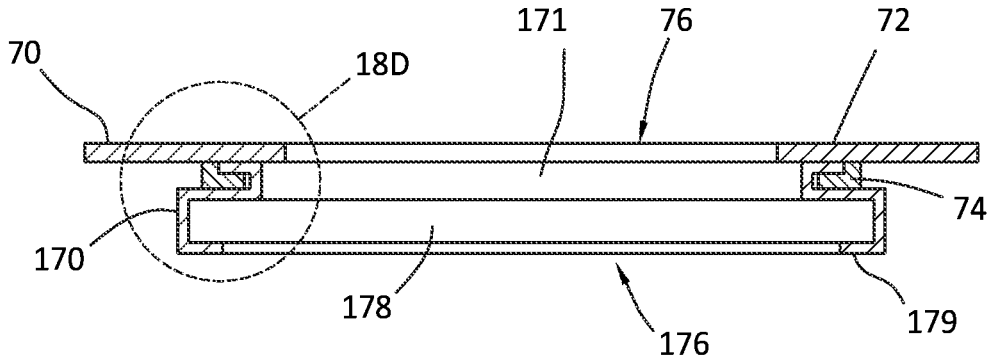
FIG. 18C is a representative partial cross-section end view of the interface structure of FIG. 18A engaged with the interface adapter of FIG. 18B for interfacing an iron roughneck to a collapsible mud bucket, in accordance with certain embodiments.

In non-limiting embodiments, FIGS. 18A-18E illustrate coupling the interface adapter 170 to the backup tong 44. FIG. 18A is a representative partial cross-section end view of the interface structure 70. Mounting the interface structure 70 to the backup tong 44 can interface the backup tong 44 with the collapsible mud bucket 100 of the current disclosure. As described above regarding FIGS. 7A, 7B, 8A, 8B, the interface structure 70 can be attached to the bottom of the backup tong 44 (or other suitable equipment). However, in these figures, the retention ring 118 can engage directly with the interface structure 70 via the U-shaped channel 78 that receives the retention ring 118. However, in the non-limiting embodiments of FIGS. 18A-18E, the U-shaped channel 78 can receive a U-shaped attachment interface 172, which engages the interface adapter 170 to the interface structure 70, as shown in FIG. 18C. The U-shaped structure 171 can include the U-shaped attachment interface 172 that forms a U-shaped channel 174. The U-shaped channel 174 faces an opposite radial direction than the U-shaped channel 178. The U-shaped structure 179 can form a flange at the bottom of the U-shaped channel 178 that can engage the retention ring 118 and hold it within the U-shaped channel 178 when the backup tong 44 is raised.

Figure 18D:
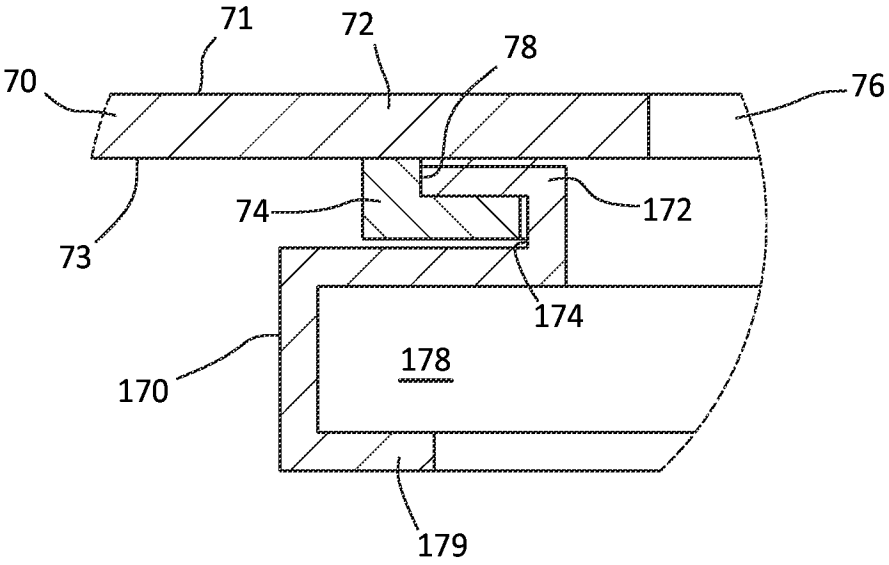
FIG. 18D is a detailed end view of a portion of the interface structure of FIG. 18A engaged with a portion of the interface adapter of FIG. 18B for interfacing an iron roughneck to a collapsible mud bucket, in accordance with certain embodiments.

In a non-limiting embodiment, FIG. 18D is a detailed end view of a portion of the interface structure 70 of FIG. 18A engaged with a portion of the interface adapter 170 of FIG. 18B for interfacing an iron roughneck 38 to a collapsible mud bucket 100 of the current disclosure. The top surface 71 of the attachment interface 72 can be coupled to a bottom attachment surface 48 of the backup tong 44. The U-shaped retention feature 74 can be attached to the bottom surface of the attachment interface 72 to form the U-shaped channel 78. The U-shaped attachment interface 172 portion of the interface adapter 170 can be received in the U-shaped channel 78 to couple the interface adapter 170 to the interface structure 70. The U-shaped structure 179 can form the U-shaped channel 178 which can receive the retention ring 118 of the mud bucket 100.

Figure 18E:
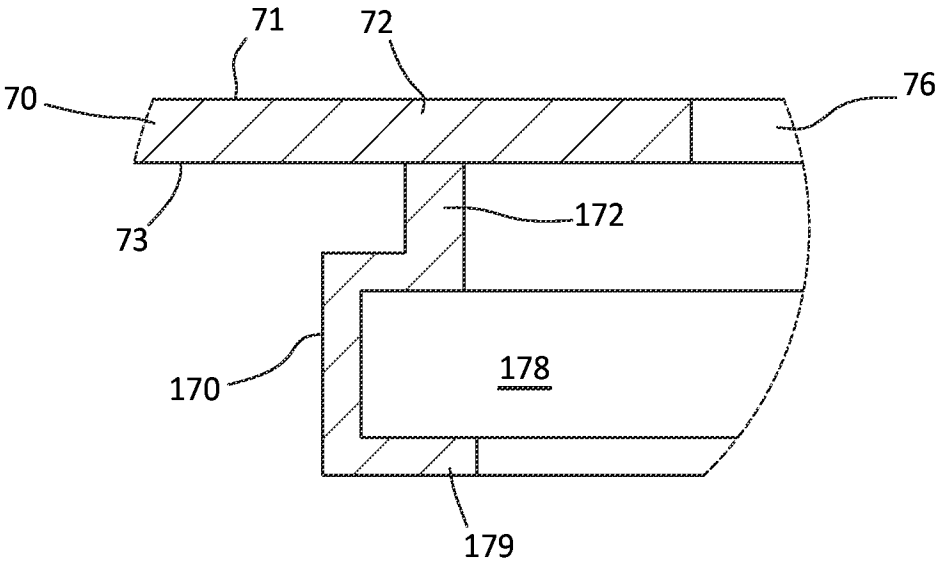
FIG. 18E is a detailed end view of the interface adapter as an integral part of the interface structure for interfacing an iron roughneck to a collapsible mud bucket, in accordance with certain embodiments.

In a non-limiting embodiment, FIG. 18E is another detailed end view of a portion of the interface structure 70 engaged with the interface adapter 170 for interfacing an iron roughneck 38 to a collapsible mud bucket 100 of the current disclosure. This embodiment is similar to the embodiment of FIG. 18D, except that the interface structure 70 of FIG. 18E is an integral part of the interface adapter 170. Therefore, the upper surface 71 of the interface structure 70 can be attached to the bottom attachment surface 48 of the backup tong 44. An attachment interface 172 can be attached to the bottom surface 73 of the interface structure 70. The U-shaped structure 179 can be attached (or formed with) the attachment interface 172 portion of the interface adapter 170 to form the U-shaped channel 178 which can receive the retention ring 118 of the mud bucket 100.

VARIOUS EMBODIMENTS

Embodiment 1. A system comprising:

a base structure configured to couple to a rig floor;

a bellows with a longitudinal internal cavity, with one end of the bellows attached to the base structure; and a retention ring attached to an opposite end of the bellows, where vertical movement of the retention ring lengthens or shortens the longitudinal internal cavity.

Embodiment 2. The system of embodiment 1, wherein the base structure comprises:

an interface chamber in fluid communication with the longitudinal internal cavity; and a drain port in fluid communication with the interface chamber.

Embodiment 3. The system of embodiment 2, wherein a majority of expelled fluid, that is received from a portion of a tubular string positioned within the longitudinal internal cavity, is directed downward toward through the longitudinal internal cavity, through the interface chamber, and out the drain port.

Embodiment 4. The system of embodiment 2, wherein the base structure further comprises a plate on which the interface chamber is mounted, with the plate comprising a plurality of pegs protruding below the plate.

Embodiment 5. The system of embodiment 4, wherein the base structure further comprises a seal configured to sealingly engage a tubular when the tubular is inserted through a center opening in the seal, and wherein the seal is positioned between the interface chamber and the plate.

Embodiment 6. The system of embodiment 4, wherein the pegs are configured to be inserted into bit breaker recesses on a rig floor.

Embodiment 7. The system of claim 1, wherein the base structure comprises a first seal configured to sealingly engage a tubular when the tubular is inserted through a first center opening in the first seal.

Embodiment 8. The system of claim 7, wherein the retention ring comprises a second seal configured to sealingly engage a tubular when the tubular is inserted through a second center opening in the second seal.

Embodiment 9. The system of claim 1, wherein the retention ring comprises a seal configured to sealingly engage a tubular when the tubular is inserted through a center opening in the seal.

Embodiment 10. The system of embodiment 1, further comprising a U-shaped channel attached to a backup tong of an iron roughneck, wherein insertion of the retention ring into the U-shaped channel couples the retention ring to the backup tong and removal of the retention ring from the U-shaped channel decouples the retention ring from the backup tong.

Embodiment 11. The system of embodiment 10, wherein the insertion and removal of the retention ring is performed manually or automatically.

Embodiment 12. A method comprising:

coupling a mud bucket to a rig floor;

raising a retention ring of the mud bucket, thereby elongating a longitudinal internal cavity of the mud bucket such that a joint of a tubular string is positioned within the longitudinal internal cavity; and unthreading the joint while the joint is positioned within the longitudinal internal cavity, wherein a tubular is connected to the tubular string at the joint and unthreading the joint disconnects the tubular from the tubular string and expels a fluid from the tubular into the longitudinal internal cavity.

Embodiment 13. The method of embodiment 12, wherein the joint of the tubular string is positioned outside of the longitudinal internal cavity prior to raising the retention ring of the mud bucket.

Embodiment 14. The method of embodiment 13, further comprising untorquing the joint via an iron roughneck prior to raising the retention ring of the mud bucket.

Embodiment 15. The method of embodiment 14, automatically raising the retention ring after the untorquing and prior to the unthreading of the joint.

Embodiment 16. The method of embodiment 14, further comprising:

collapsing the longitudinal internal cavity after the fluid is removed from well center by lowering the retention ring; and raising the tubular string out of a wellbore until a next joint to be unthreaded is positioned vertically above the mud bucket.

Embodiment 17. The method of embodiment 16, further comprising repeating the following operations of:

1) untorquing the next joint,
2) elongating the longitudinal internal cavity via raising the retention ring,
3) unthreading the next joint,
4) removing the fluid from the well center,
5) collapsing the longitudinal internal cavity via lowering the retention ring, and
6) raising the tubular string until another joint is positioned above the mud bucket for each joint of the tubular string to be unthreaded as the tubular string is being at least partially removed from the wellbore.

Embodiment 18. The method of embodiment 12, wherein the longitudinal internal cavity is formed by a bellows with an upper end of the bellows selectively coupled, via the retention ring, to a backup tong of an iron roughneck, and a lower end of the bellows being coupled to the rig floor.

Embodiment 19. The method of embodiment 18, wherein raising the backup tong raises the retention ring and elongates the longitudinal internal cavity, and wherein lowering the backup tong lowers the retention ring and collapses the longitudinal internal cavity.

Embodiment 20. The method of embodiment 12, further comprising flowing the fluid downward through the longitudinal internal cavity, through an interface chamber of the mud bucket, and out a drain port coupled to the interface chamber, thereby removing a majority of the fluid from the tubular, flowing the fluid through the mud bucket and away from well center.

Embodiment 21. The method of embodiment 12, further comprising sealingly engaging the tubular string with a lower seal of the mud bucket, the lower seal being positioned at a lower end of the mud bucket.

Embodiment 22. The method of embodiment 21, further comprising raising the tubular string while the lower seal remains sealingly engaged with the tubular string.

Embodiment 23. The method of embodiment 21, further comprising sealingly engaging the tubular string with an upper seal of the mud bucket, the upper seal being positioned at an upper end of the mud bucket.

Embodiment 24. A method comprising:

raising a tubular string through a mud bucket at well center on a rig until a joint is positioned above the mud bucket;

untorquing the joint via a torque wrench and backup tong;

elongating a bellows of the mud bucket to elongate a longitudinal internal cavity of the mud bucket;

unthreading the joint to disconnect a tubular from the tubular string;

releasing fluid from the tubular into the longitudinal internal cavity;

capturing the fluid in the longitudinal internal cavity; and flowing the fluid away from the well center via a drain port of the mud bucket.

Embodiment 25. The method of embodiment 24, further comprising collapsing the bellows such that a stump of the tubular string is positioned outside and above the mud bucket.

Embodiment 26. The method of embodiment 25, repeating each of the forgoing operations for each joint of the tubular string that is to be unthreaded during a process to remove at least a portion of the tubular string from a wellbore.

Embodiment 27. The method of embodiment 24, wherein elongating the bellows further comprises elongating the bellows by raising a retention ring of the mud bucket.

Embodiment 28. A system for performing a subterranean operation, the system comprising:

a base structure configured to couple to a lower side of a backup tong;

a bellows having a longitudinal internal cavity, with one end of the bellows coupled to an upper side of the backup tong of an iron roughneck and an opposite end of the bellows coupled to a retention ring that is coupled to a lower side of a torque wrench of an iron roughneck, wherein vertical movement of the retention ring lengthens or shortens the longitudinal internal cavity.

Embodiment 29. The system of embodiment 28, wherein the base structure comprises:

an interface chamber in fluid communication with the longitudinal internal cavity; and a drain port in fluid communication with the interface chamber.

Embodiment 30. The system of embodiment 29, wherein a majority of expelled fluid, that is received from a portion of a tubular string positioned within the longitudinal internal cavity, is directed downward toward through the longitudinal internal cavity, through the backup tong, through the interface chamber, and out the drain port.

Embodiment 31. The system of embodiment 29, wherein the base structure further comprises a plate on which the interface chamber is mounted.

Embodiment 32. The system of embodiment 31, wherein the base structure further comprises a seal configured to sealingly engage a tubular when the tubular is inserted through a center opening in the seal, and wherein the seal is positioned between the interface chamber and the plate.

Embodiment 33. The system of embodiment 32, wherein the seal comprises a resilient material, and wherein the seal remains sealingly engaged with the tubular when the tubular extends through the seal.

Embodiment 34. The system of embodiment 32, wherein the seal comprises an expandable bladder, wherein flowing fluid into the bladder expands the bladder into engagement with the tubular when the tubular extends through the seal, and wherein flowing fluid out of the bladder collapses the bladder away from engagement with the tubular when the tubular extends through the seal.

Embodiment 35. The system of embodiment 28, further comprising a U-shaped channel attached to the torque wrench, wherein insertion of the retention ring into the U-shaped channel couples the retention ring to the torque wrench and removal of the retention ring from the U-shaped channel decouples the retention ring from the torque wrench.

Embodiment 36. The system of embodiment 35, wherein the insertion and removal of the retention ring is performed manually or automatically.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A system for performing a subterranean operation, the system comprising:

a base structure configured to couple to a rig floor;

a bellows with a longitudinal internal cavity, with one end of the bellows attached to the base structure; and a retention ring attached to an opposite end of the bellows, wherein vertical movement of the retention ring lengthens or shortens the longitudinal internal cavity, wherein the base structure comprises an interface chamber in fluid communication with the longitudinal internal cavity, and a drain port in fluid communication with the interface chamber.

2. The system of claim 1, wherein a majority of expelled fluid, that is received from a portion of a tubular string positioned within the longitudinal internal cavity, is directed downward through the longitudinal internal cavity, through the interface chamber, and out the drain port.

3. The system of claim 1, wherein the base structure further comprises a plate on which the interface chamber is mounted, with the plate comprising a plurality of pegs protruding below the plate.

4. The system of claim 1, wherein the base structure comprises a first seal configured to sealingly engage a tubular when the tubular is inserted through a first center opening in the first seal.

5. The system of claim 4, wherein the retention ring comprises a second seal configured to sealingly engage a tubular when the tubular is inserted through a second center opening in the second seal.

6. The system of claim 1, wherein the retention ring comprises a seal configured to sealingly engage a tubular when the tubular is inserted through a center opening in the seal.

7. The system of claim 1, further comprising a U-shaped channel attached to a backup tong of an iron roughneck, wherein insertion of the retention ring into the U-shaped channel couples the retention ring to the backup tong and removal of the retention ring from the U-shaped channel decouples the retention ring from the backup tong.

8. The system of claim 7, wherein insertion and removal of the retention ring is performed manually or automatically.

9. A method for performing a subterranean operation, the method comprising:

coupling a mud bucket to a rig floor;

raising a retention ring of the mud bucket, thereby elongating a longitudinal internal cavity of the mud bucket such that a connection of a tubular string is positioned within the longitudinal internal cavity; and unthreading the connection while the connection is positioned within the longitudinal internal cavity, wherein a tubular is connected to the tubular string at the connection and unthreading the connection disconnects the tubular from the tubular string and expels a fluid from the tubular into the longitudinal internal cavity, and wherein the longitudinal internal cavity is formed by a bellows.

10. The method of claim 9, wherein the connection of the tubular string is positioned outside of the longitudinal internal cavity prior to raising the retention ring of the mud bucket.

11. The method of claim 10, further comprising untorquing the connection via an iron roughneck prior to raising the retention ring of the mud bucket.

12. The method of claim 11, automatically raising the retention ring after the untorquing and prior to the unthreading of the connection.

13. The method of claim 11, further comprising:

collapsing the longitudinal internal cavity after the fluid is removed from a well center by lowering the retention ring; and raising the tubular string out of a wellbore until a next connection to be unthreaded is positioned vertically above the mud bucket.

14. The method of claim 13, further comprising repeating the following operations of:

1) untorquing the next connection,
2) elongating the longitudinal internal cavity via raising the retention ring,
3) unthreading the next connection,
4) removing the fluid from the well center,
5) collapsing the longitudinal internal cavity via lowering the retention ring, and
6) raising the tubular string until another connection is positioned above the mud bucket for each connection of the tubular string to be unthreaded as the tubular string is being at least partially removed from the wellbore.

15. The method of claim 9, wherein an upper end of the bellows is selectively coupled, via the retention ring, to a backup tong of an iron roughneck, and a lower end of the bellows is coupled to the rig floor.

16. The method of claim 15, wherein raising the backup tong raises the retention ring and elongates the longitudinal internal cavity, and wherein lowering the backup tong lowers the retention ring and collapses the longitudinal internal cavity.

17. The method of claim 9, further comprising flowing the fluid downward through the longitudinal internal cavity, through an interface chamber of the mud bucket, and out a drain port coupled to the interface chamber, thereby removing a majority of the fluid from the tubular, flowing the fluid through the mud bucket and away from a well center.

18. The method of claim 9, further comprising sealingly engaging the tubular string with a lower seal of the mud bucket, the lower seal being positioned at a lower end of the mud bucket.

19. The method of claim 18, further comprising raising the tubular string while the lower seal remains sealingly engaged with the tubular string.

20. The method of claim 18, further comprising sealingly engaging the tubular string with an upper seal of the mud bucket, the upper seal being positioned at an upper end of the mud bucket.

* * * * *